US007863824B2

(12) United States Patent
Yamazaki et al.

(10) Patent No.: US 7,863,824 B2
(45) Date of Patent: Jan. 4, 2011

(54) LIGHT EMITTING DEVICE AND PRODUCTION SYSTEM OF THE SAME

(75) Inventors: Shunpei Yamazaki, Tokyo (JP); Hajime Kimura, Kanagawa (JP); Mai Akiba, Kanagawa (JP); Aya Anzai, Kanagawa (JP); Yu Yamazaki, Tokyo (JP)

(73) Assignee: Semiconductor Energy Laboratory Co., Ltd., Kanagawa-Ken (JP)

( * ) Notice: Subject to any disclaimer, the term of this patent is extended or adjusted under 35 U.S.C. 154(b) by 174 days.

(21) Appl. No.: 12/272,825

(22) Filed: Nov. 18, 2008

(65) Prior Publication Data

US 2009/0081816 A1 Mar. 26, 2009

Related U.S. Application Data

(60) Continuation of application No. 10/923,840, filed on Aug. 24, 2004, now Pat. No. 7,456,579, and a division of application No. 10/419,842, filed on Apr. 22, 2003, now Pat. No. 6,911,781.

(30) Foreign Application Priority Data

Apr. 23, 2002 (JP) ..... 2002-120880
Aug. 30, 2002 (JP) ..... 2002-252826

(51) Int. Cl.
*G09G 3/10* (2006.01)

(52) U.S. Cl. ..... 315/169.1; 315/169.2; 315/169.3; 315/291; 315/224; 345/98; 345/92; 345/82; 345/204; 345/214

(58) Field of Classification Search ..... 315/167, 315/169.1–169.3, 291, 294, 312, 224; 345/36, 345/42, 44–46, 82, 84, 92, 98, 204, 212, 345/214, 475
See application file for complete search history.

(56) References Cited

U.S. PATENT DOCUMENTS 5,247,190 A 9/1993 Friend et al.

(Continued)

FOREIGN PATENT DOCUMENTS

EP 0 905 673 A1 3/1999

(Continued)

OTHER PUBLICATIONS

Tsutsui et al., "Electroluminescence in Organic Thin Films", Photochemical Processes in Organized Molecular Systems, 1991, pp. 437-450 (Elsevier Science Publishers, Tokyo, 1991).

(Continued)

*Primary Examiner*—Haissa Philogene
(74) *Attorney, Agent, or Firm*—Nixon Peabody LLP; Jeffrey L. Costellia

(57) ABSTRACT

To provide a light emitting device without nonuniformity of luminance, a correcting circuit for correcting a video signal supplied to each pixel to a light emitting device. The correcting circuit is stored with data of a dispersion of a characteristic of a driving TFT among pixels and data of a change over time of luminance of a light emitting element. Further, by correcting a video signal inputted to the light emitting device in conformity with a characteristic of the driving TFT of each pixel and a degree of a deterioration of the light emitting element based on the over-described two data, nonuniformity of luminance caused by a deterioration of an electroluminescent layer and nonuniformity of luminance caused by dispersion of a characteristic of the driving TFT are restrained.

20 Claims, 21 Drawing Sheets

U.S. PATENT DOCUMENTS

| | | | | |
|---|---|---|---|---|
| 5,399,502 | A | 3/1995 | Friend et al. | |
| 5,793,344 | A | 8/1998 | Koyama | |
| 6,060,840 | A | 5/2000 | Foo et al. | |
| 6,188,454 | B1 | 2/2001 | Greene et al. | |
| 6,204,610 | B1 | 3/2001 | Komiya | |
| 6,229,508 | B1 | 5/2001 | Kane | |
| 6,246,180 | B1 | 6/2001 | Nishigaki | |
| 6,275,061 | B1 | 8/2001 | Tomita | |
| 6,317,138 | B1 | 11/2001 | Yano et al. | |
| 6,404,139 | B1 | 6/2002 | Saski et al. | |
| 6,476,779 | B1 | 11/2002 | Yano et al. | |
| 6,489,938 | B1 | 12/2002 | Ito | |
| 6,489,952 | B1 | 12/2002 | Tanaka et al. | |
| 6,498,592 | B1 | 12/2002 | Matthies | |
| 6,501,227 | B1 | 12/2002 | Koyama | |
| 6,501,230 | B1 | 12/2002 | Feldman | |
| 6,507,227 | B2 | 1/2003 | Genova et al. | |
| 6,512,469 | B1 | 1/2003 | Azami et al. | |
| 6,518,962 | B2 | 2/2003 | Kimura et al. | |
| 6,570,611 | B1 | 5/2003 | Satou et al. | |
| 6,590,581 | B1 | 7/2003 | Koyama et al. | |
| 6,618,030 | B2 | 9/2003 | Kane et al. | |
| 6,628,248 | B2 | 9/2003 | Masumoto et al. | |
| 6,630,840 | B2 | 10/2003 | Tomita | |
| 6,635,505 | B2 | 10/2003 | Tanaka et al. | |
| 6,700,330 | B2 | 3/2004 | Koyama | |
| 6,710,548 | B2 | 3/2004 | Kimura | |
| 6,750,792 | B2 | 6/2004 | Azami et al. | |
| 6,753,854 | B1 | 6/2004 | Koyama et al. | |
| 6,774,578 | B2 | 8/2004 | Tanada | |
| 6,911,781 | B2 | 6/2005 | Yamazaki et al. | |
| 7,042,427 | B2 | 5/2006 | Inukai | |
| 7,049,983 | B2 | 5/2006 | Azami et al. | |
| 7,053,874 | B2 | 5/2006 | Koyama | |
| 7,088,052 | B2 * | 8/2006 | Kimura | 315/169.2 |
| 7,158,157 | B2 | 1/2007 | Yamazaki et al. | |
| 7,198,967 | B2 | 4/2007 | Tanaka et al. | |
| 7,227,519 | B1 | 6/2007 | Kawase et al. | |
| 7,362,322 | B2 | 4/2008 | Kimura et al. | |
| 7,456,579 | B2 * | 11/2008 | Yamazaki et al. | 315/169.3 |
| 7,586,505 | B2 | 9/2009 | Yamazaki et al. | |
| 2001/0020922 | A1 | 9/2001 | Yamazaki et al. | |
| 2001/0024186 | A1 | 9/2001 | Kane et al. | |
| 2002/0024481 | A1 | 2/2002 | Kawabe et al. | |
| 2002/0033783 | A1 | 3/2002 | Koyama | |
| 2002/0047550 | A1 | 4/2002 | Tanada | |
| 2002/0101395 | A1 | 8/2002 | Inukai | |
| 2002/0105279 | A1 | 8/2002 | Kimura | |
| 2003/0057895 | A1 | 3/2003 | Kimura | |
| 2006/0192699 | A1 | 8/2006 | Azami et al. | |
| 2007/0166860 | A1 | 7/2007 | Tanaka et al. | |

FOREIGN PATENT DOCUMENTS

| | | | |
|---|---|---|---|
| EP | 0 923 067 | A1 | 6/1999 |
| EP | 1 003 151 | A2 | 5/2000 |
| EP | 1 026 656 | A2 | 8/2000 |
| EP | 1 128 439 | A2 | 8/2001 |
| EP | 1 225 557 | A1 | 7/2002 |
| EP | 1 310 938 | A2 | 5/2003 |
| JP | 10-031449 | | 2/1998 |
| JP | 10-92576 | | 4/1998 |
| JP | 10-254410 | | 9/1998 |
| JP | 11-015437 | | 1/1999 |
| JP | 11-219146 | | 8/1999 |
| JP | 11-305722 | | 11/1999 |
| JP | 11-344949 | | 12/1999 |
| JP | 2000-066633 | | 3/2000 |
| JP | 2000-221942 | | 8/2000 |
| JP | 2000-267628 | | 9/2000 |
| JP | 2000-338920 | | 12/2000 |
| JP | 2000-347598 | | 12/2000 |
| JP | 2001-013908 | | 1/2001 |
| JP | 2001-022323 | | 1/2001 |
| JP | 2001-027891 | | 1/2001 |
| JP | 2001-134754 | | 5/2001 |
| JP | 2001-159878 | | 6/2001 |
| JP | 2001-184016 | | 7/2001 |
| JP | 2001-343933 | | 12/2001 |
| JP | 2001-350442 | | 12/2001 |
| JP | 2002-175041 | | 6/2002 |
| JP | 2003-177714 | | 6/2003 |
| JP | 2004-038210 | | 2/2004 |
| WO | WO 90/13148 | | 11/1990 |
| WO | WO-00/49636 | | 8/2000 |
| WO | WO-00/77533 | A2 | 12/2000 |
| WO | WO-01/26085 | A1 | 4/2001 |

OTHER PUBLICATIONS

M. A. Baldo et al., "Highly Efficient Phosphorescent Emission from Organic Electroluminescent Devices", Nature vol. 395, Sep. 10, 1998, pp. 151-154.

M. A. Baldo et al., "Very High-Efficiency Green Organic Light-Emitting Devices Based on Electrophosphorescence", Applied Physics Letters vol. 75, No. 1, Jul. 5, 1999, pp. 4-6.

H. Shenk et al., "Polymers for Light-Emitting Diodes", Euro Display Proceedings 1999, pp. 33-37.

Tsutsui et al., "High Quantum Efficiency in Organic Light-Emitting Devices with Iridium-Complex as Triplet Emissive Center", Japanese Journal of Applied Physics vol. 38, Part 2, No. 12B, Dec. 15, 1999, pp. L1502-L1504.

* cited by examiner

Fig. 3A change of luminance over time when correction is not performed
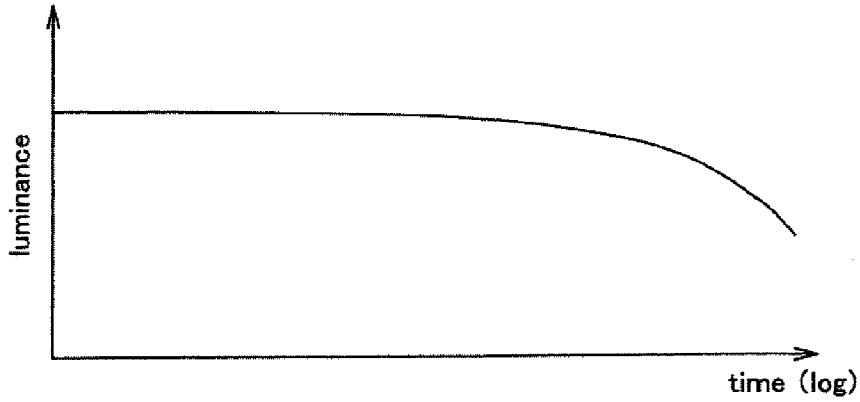
Fig. 3B change of voltage over time when correction is performed
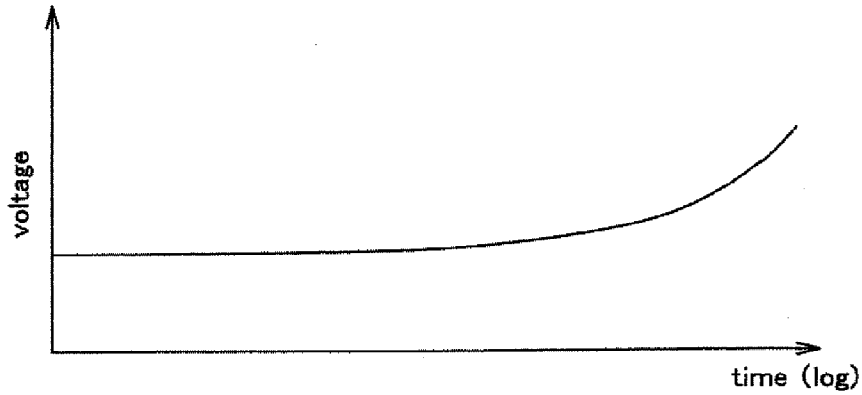
Fig. 3C change of liminance over time when correction is performed
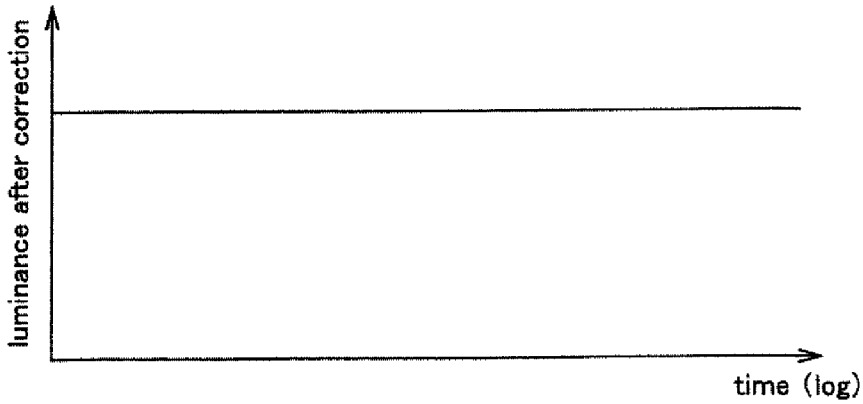

LIGHT EMITTING DEVICE AND PRODUCTION SYSTEM OF THE SAME

BACKGROUND OF THE INVENTION

1. Field of the Invention

The present invention relates to an electroluminescent panel (herein after, simply referred to as panel) sealing a light emitting element formed over a substrate between the substrate and a cover member. Further, the invention relates to an electroluminescent module where an IC including a controller is mounted over the panel. Further, in the specification, both of the panel and the electroluminescent module are generally referred to as luminescent device.

2. Description of the Related Art

A light emitting element spontaneously emits light and therefore, having high visibility, dispensing with a backlight needed in a liquid crystal display (LCD), optimum for thin formation and not restricted in viewing angle. Therefore, in recent years, a luminescent device using a light emitting element attract attention as a display device substituting for CRT or LCD.

Further, in the specification, a light emitting element generally includes an element luminance of which is controlled by current or voltage and includes an electron source element (electron discharge element) of MIM type used in OLED (Organic Light Emitting Diode) or FED (Field Emission Display).

OLED which is one of light emitting elements includes a layer including a compound providing electroluminescence generated by applying an electric field (electroluminescent material) (herein after, referred to as electroluminescent layer), an anode layer and a cathode layer. As luminescence in the electroluminescent material, there are luminescence in returning from a singlet excited state to a ground state (fluorescence) and luminescence in returning from a triplet excited state to the ground state (phosphorescence).

The electroluminescent layer specifically includes a light emitting layer, a hole injecting layer, an electron injecting layer, a hole transporting layer and an electron transporting layer. OLED is basically constructed by a structure of successively laminated anode/light emitting layer/cathode and, other than the structure, may be constructed by a structure of successively laminated anode/hole injecting layer/light emitting layer/cathode, or anode/hole injecting layer/light emitting layer/electron transporting layer/cathode. Further, an inorganic compound may be included in the layers.

Meanwhile, lowering of luminance of OLED in accordance with a deterioration in an electroluminescent material poses a serious problem in putting light emitting devices into practical use.

FIG. 17A shows a change over time of luminance of a light emitting element when constant current is supplied between two electrodes of the light emitting element. As shown by FIG. 17A, even when constant current is made to flow there between, an electroluminescent material is deteriorated with elapse of time and luminance of the light emitting element is lowered.

Further, FIG. 17B shows a change over time of luminance of a light emitting element when constant voltage is applied between two electrodes of the light emitting element. As shown by FIG. 17B, even when constant voltage is applied there between, luminance of the light emitting element is lowered with elapse of time. It seems that as shown by FIG. 17A, luminance with respect to the constant current is lowered by deterioration of an electroluminescent material and as shown by FIG. 17C, current flowing in the light emitting element when applied with constant voltage is reduced over time.

In most cases, gray scale displayed at each pixel differs by an image and therefore, in the case of a time gray scale system using a digital video signal, a period of emitting light by a light emitting element differs among pixels. Further, even in the case of using an analog video signal, a period of emitting light by a light emitting element and an amount of current supplied to a light emitting element differ among pixels. Therefore, the deterioration of the light emitting element of each pixel differs with elapse of time and luminance is dispersed.

Lowering of the luminance of the light emitting element by the deterioration can be compensated for by increasing current supplied to the light emitting element or increasing drive voltage. However, it is not realistic to provide a power source for supplying voltage or current in correspondence with each pixel and therefore, actually, a common power source for supply voltage or current for all of pixels or a certain number of pixel is provided. When voltage or current supplied from the common power source is simply increased to compensate for lowering of luminance of a light emitting element in accordance with the deterioration, in all of pixelsupplied with the voltage or current, luminance of light emitting elements is increased on an average and a dispersion in luminance among pixels cannot be resolved.

In order to resolve the dispersion of luminance among pixels caused by deterioration, according to Patent reference 1, mentioned below, it is described to maintain luminance of a screen to be equivalent to that before deterioration by counting an accumulated period of lighting a light emitting element and preserving the period in a memory and correcting a video signal based on data of a previously prepared deterioration characteristic.

(Patent Literature 1)

Japanese Patent Laid-Open No. 2002-175041

However, the dispersion of luminance among pixels is not only caused by the deterioration but also by a dispersion in a characteristic of TFTs among pixels as explained below.

In the case of a light emitting device of an active matrix type, current flowing in a light emitting element of each pixel is controlled by a thin film transistor (TFT) similarly provided to each pixel. FIG. 18 shows a circuit diagram of a pixel of general light emitting device. A pixel shown in FIG. 18 includes two TFTs of a switching TFT 5000 and a driving TFT 5001, a light emitting element 5002 and a storage capacitor 5003.

The gate of the switching TFT 5000 is connected to a scanning line 5004. One of the source and the drain is connected to a signal line 5005 and other thereof is connected to the gate of the driving TFT 5001. One of the source and the drain of the driving TFT 5001 is connected to a power source line 5006 and the other thereof is connected to a pixel electrode (anode or cathode) provided to the light emitting element 5002. One of two electrodes provided to the storage capacitor is connected to the power source line 5006 and other thereof is connected to the gate of the driving TFT 5001.

Further, in the specification, connection signifies electric connection unless specified otherwise.

Switching of switching TFT 5000 is controlled by voltage applied to the scanning line 5004. When the switching TFT 5000 is made ON, a video signal inputted to the signal line 5005 is inputted to the gate of the driving TFT 5001. Further, current of an amount in correspondence with the video signal inputted to the gate of the driving TFT 5001 is supplied to the light emitting element 5002 to thereby control luminance of the light emitting element 5002.

When a characteristics of the driving TFT 5001 for supplying current to the light emitting element 5002 are dispersed among pixels, current applied to the light emitting element 5002 is also dispersed. That is, the dispersion in the characteristic of the driving TFT 5001 causes dispersion of the luminance among pixels.

According to technology described in Patent reference 1, dispersion of luminance caused by dispersion of a characteristic of TFT cannot be restrained.

SUMMARY OF THE INVENTION

It is a purpose of the invention in view of the over-described to provide a light emitting device capable of restraining nonuniformity of luminance caused by a deterioration in an field light emitting layer or a dispersion in a TFT characteristic among pixels and capable of restraining a reduction in the luminance of a total of a screen and a production system of the light emitting device.

According to the invention, in view of the over described problem, the following means are provided.

According to the invention, in order to restrain nonuniformity of luminance by a deterioration of an electroluminescent layer and nonuniformity of luminance by a dispersion of characteristics of driving TFTs, a correcting circuit for correcting a video signal supplied to each pixel is provided to a light emitting device. The correcting circuit may be fabricated along with TFT over an element substrate on over which a light emitting element and a TFT are formed, or may be formed separately and mounted to a panel.

The correcting circuit is stored with data of a dispersion of characteristics of driving TFTs among pixels and data of a change over time of luminance of the light emitting elements. Further, based on the two data, a video signal inputted to the light emitting device is corrected in conformity with the characteristic of the driving TFT of each pixel and a degree of the deterioration of the light emitting element such that nonuniformity of luminance is not caused.

Data of the variation of the characteristic of the driving TFT is stored into the correcting circuit by a maker before delivering the light emitting device as a product, that is, before being used by an end user. Specifically, a light emitting element is sealed between a substrate and a cover member and completed as a panel and thereafter, current flowing to the light emitting element of each pixel is successively measured. Data including the dispersion of the characteristics of the driving TFT provided by the measurement as information are successively written to a volatile memory.

Further, data stored to the volatile memory is written to a nonvolatile memory inside the correcting circuit to store. The correcting device is provided with a function of correcting video signals inputted to the light emitting device based on data of the dispersion of the characteristics of the driving TFTs stored in the nonvolatile memory. For example, when ON current is small and a gray scale lower than a desired value is displayed, the video signal is corrected to increase a number of the gray scale. Conversely, when the ON current is large and a gray scale higher than a desired value is displayed, the video signal is corrected to reduce the number of gray scale.

Therefore, when used by the end user, based on the data of the dispersion of the characteristics of the driving TFTs previously stored by the maker, the video signals are corrected for respective pixels and nonuniformity of luminance by the dispersion of the driving TFTs is restrained.

Further, the volatile memory used in measuring the current flowing in the light emitting element of each pixel successively is not needed after writing data of the dispersion of the characteristics of the driving TFTs provided as information to the nonvolatile memory inside the correcting circuit and therefore, it is preferable to separate the volatile memory from the light emitting device before conveyed to the end user by being delivered as a product.

Further, in the correcting device, a video signal supplied to the light emitting device is sampled always or periodically. Further, a gray scale displayed at each pixel is detected from a period of making the light emitting element of each pixel emit light or an amount of current supplied to the light emitting element. Successively, one pixel constituting a reference is selected, an accumulated value (sum) of the detected value and data of a change over time of the luminance of the light emitting element previously stored are compared and supplied voltage is corrected to thereby provide desired luminance at the pixel. A designer can pertinently set the pixel constituting the reference.

For example, when the reference is constituted by a pixel which is most significantly deteriorated to reduce luminance, other pixelsupplied with voltage from a power source common to that of the pixel which is most significantly deteriorated is supplied with a excessively high voltage and therefore, it seems that the luminance becomes higher than that of the pixel which is most significantly deteriorated and a number of gray scale is increased. In these pixels, by comparing the accumulated value of the detected value of each pixel and previously stored data of the change over time of the luminance of the light emitting element, the video signals inputted to the deteriorated pixels of the light emitting elements is corrected at each time and the number of gray scales are reduced.

Conversely, when the correction is carried out by constituting a reference by a pixel which is least deteriorated, by comparing an accumulated value of the detected value of the pixel and previously stored data of a change over time of luminance of the light emitting element, voltage supplied to the pixel is corrected to provide desired luminance. On this occasion, in other pixelsupplied with voltage from a power source common to that of the pixel which is least deteriorated, voltages to be supplied is still deficient and therefore, it seems that the luminance is lower than that of the pixel which is least deteriorated and the number of gray scales stay to be lower than desired values. In these pixels, by comparing the accumulated value of the detected value of each pixel and previously stored data of a change over time of the luminance of the light emitting element, the video signal inputted to the deteriorated pixel of the light emitting element is corrected at each time and the number of gray scale is increased.

That is, in the pixel which is more deteriorated than the pixel constituting the reference, the video signal may be corrected to increase the number of gray scale and in the pixel which is less deteriorated, the video signal may be corrected to reduce the number of gray scale.

By the over-described constitution, even when the degrees of deterioration of the light emitting elements in pixels differ respectively, uniformity of luminance of a screen can be maintained without bringing about nonuniformity of luminance and further, the reduction of the luminance by the deterioration can be restrained.

Further, the light emitting element used in the invention can take also a mode in which a hole injecting layer and an electron injecting layer, a hole transporting layer or an electron transporting layer are formed by a material of an inorganic compound per se or an organic compound mixed with an inorganic compound. Further, portions of the layers may be mixed to each other.

BRIEF DESCRIPTION OF THE DRAWINGS

FIGS. 3A, 3B and 3C are diagrams showing a change over time of voltage and luminance of a light emitting element;

DETAILED DESCRIPTION OF PREFERRED EMBODIMENTS

Embodiment 1

Figure 1:
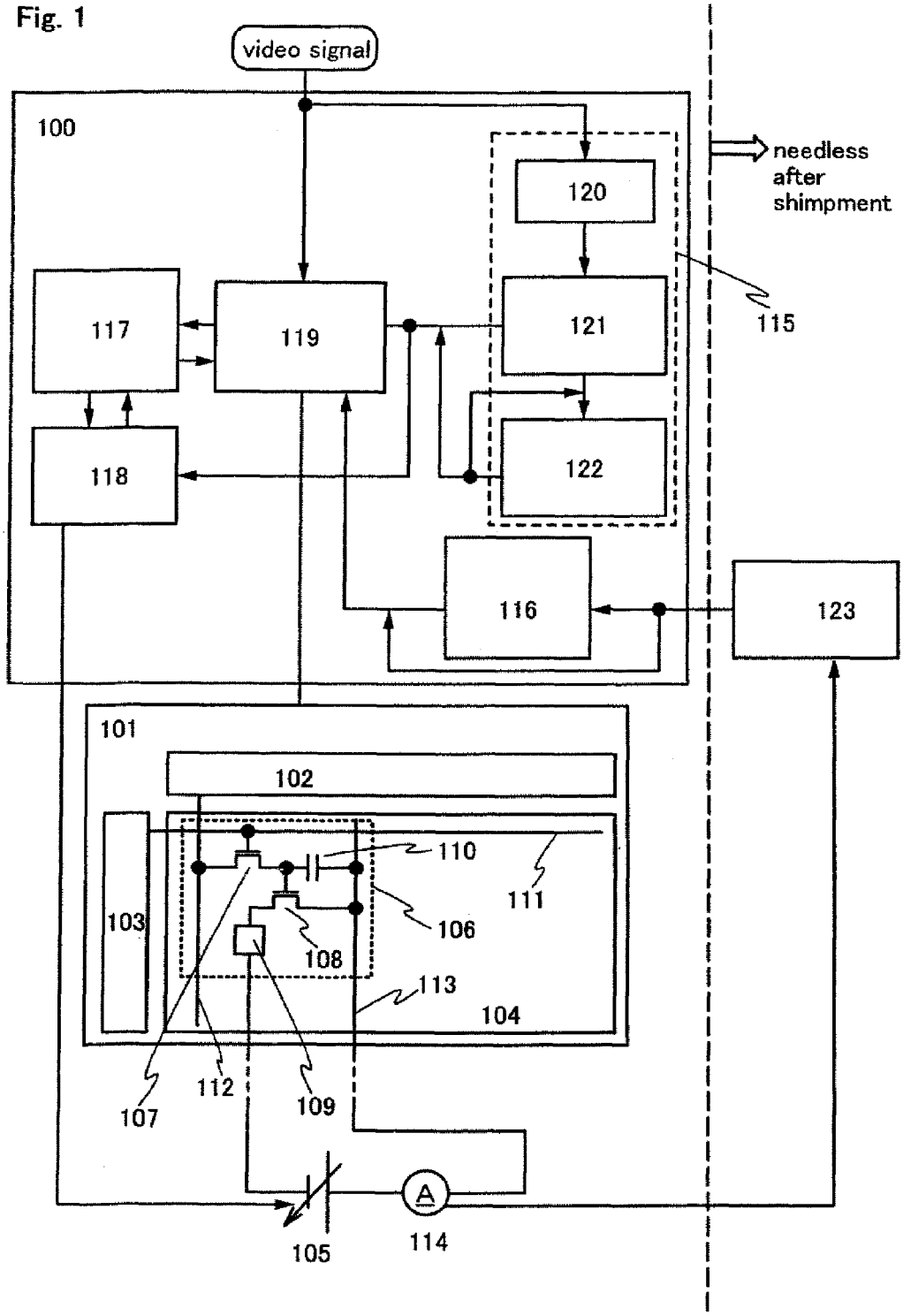
FIG. 1 is a block diagram of a light emitting device of the invention.

A constitution of a light emitting device of the invention will be explained as follows. FIG. 1 is a block diagram of a light emitting device of the invention including a correcting circuit 100, a panel 101 and a voltage source 105. Further, other than these, a circuit necessary for driving a controller or the like may be included.

The panel 101 shown in FIG. 1 includes a signal line drive circuit 102, a scanning line drive circuit 103 and a pixel portion 104. Further, although in FIG. 1, the correcting circuit 100 and the voltage source 105 are formed over a substrate different from an element substrate formed with the signal line drive circuit 102, the scanning line drive circuit 103 and the pixel portion 104, these may be formed over the same substrate when possible. Further, the signal line drive circuit 102 and the scanning line drive circuit 103 may be formed over a substrate different from the element substrate formed with the pixel portion 104. Although connection between the voltage source 105 and the pixel portion differs by a constitution of a pixel, it is important to connect these such that a height of voltage applied to a light emitting element can necessarily be controlled.

The pixel portion 104 is provided with a plurality of pixels having light emitting elements. Only a single pixel 106 is shown in FIG. 1. The pixel 106 includes a switching TFT 107, a driving TFT 108, a light emitting element 109 and a storage capacitor 110. The gate of the switching TFT 107 is connected to a scanning line 111, one of the source and the drain is connected to a signal line 112 and the other thereof is connected to the gate of the driving TFT 108. One of the source and the drain of the driving TFT 108 is connected to a power source line 113 and the other thereof is connected to a pixel electrode of the light emitting element 109. The light emitting element includes an electroluminescent layer between the pixel electrode and an opposed electrode and a designer can pertinently determine which of an anode and cathode thereof constitutes the pixel electrode or the opposed electrode. One of two electrodes provided to the storage capacitor is connected to the power source line 113 and the other thereof is connected to the gate of the driving TFT 108.

A predetermined voltage difference is produced between the power source supply line 113 and the opposed electrode of the light emitting element 109 by the voltage source 105. Further, current flowing between the power source supply line 113 and the opposed electrode of the light emitting element 109 can be measured by an ammeter 114.

Further, the pixel shown in FIG. 1 is only an example of a constitution of the pixel provided to the light emitting device of the invention. Voltage applied to the light emitting element of each pixel may be controllable by the voltage source 105.

Meanwhile, the correcting circuit 100 includes a monitoring portion 115 for monitoring a light emitting period of the light emitting element of each pixel or an amount of current flowing to the light emitting element from an inputted video signal, a pixel characteristic correcting data storing portion (first storing means) 116 for storing data having a dispersion in a characteristic of the driving TFT of each pixel as information, a deterioration characteristic correcting data storing portion (second storing portion) 117 for storing a change over time of the luminance of the light emitting element or a change in the luminance of the light emitting element relative to the current amount as data, and a voltage correcting circuit 118 for controlling voltage supplied from the voltage source 105. The monitoring portion 115 specifically includes a counter portion 120, a volatile memory for video signal 121 and a nonvolatile memory for video signal 122. Further, there is provided a video signal correcting circuit 119 capable of correcting the inputted video signal, changing the luminance of the light emitting element of each pixel or changing the light emitting period.

Both of the pixel characteristic correcting data storing portion 116 and the deterioration characteristic correcting data storing portion 117 are constituted by nonvolatile memories.

Further, numeral 123 designates a volatile memory for pixels which is a portion for temporarily storing the amount of current flowing to the light emitting element 109 of each pixel measured by the ammeter 114.

Next, operation of the correcting circuit 100 will be explained. First, at a time point of completing the panel, the current flowing to the light emitting element of each pixel is monitored and a dispersion in the characteristic of the driving TFT is grasped.

Figure 2A:
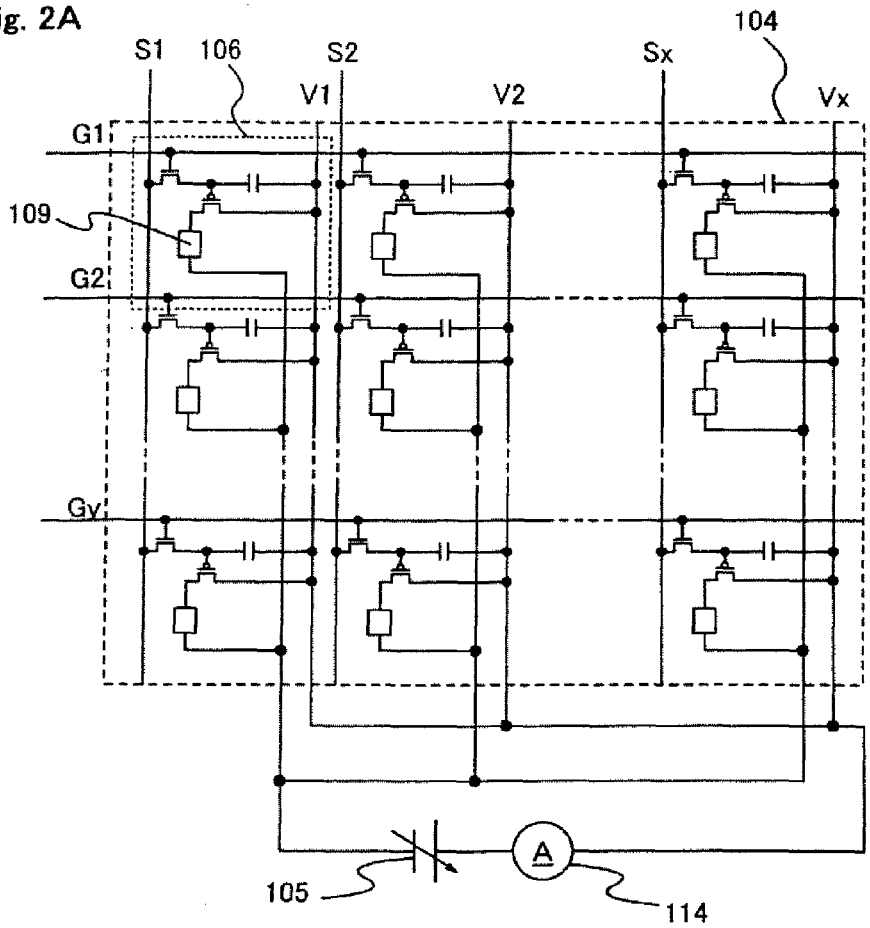
FIGS. 2A and 2B are a circuit diagram of a pixel portion of a light emitting device of the invention and a timing chart thereof.

FIG. 2A shows the constitution of the pixel portion. The pixel portion 104 is provided with the signal lines 112 (S1 through Sx), the power source lines 113 (V1 through Vx) and the scanning lines 111 (G1 through Gy). Further, numbers of the signal lines and the power source lines are not necessarily the same. Further, other than the wirings, other different wiring may be provided.

Predetermined voltage is applied between the opposed electrodes of the light emitting elements 109 of the respective pixels 106 and the power source lines V1 through Vx by the voltage source 105. Further, current between the opposed electrodes of the light emitting elements 109 and the power source lines V1 through Vx can be measured by the ammeter 114.

The voltage source 105 is a variable power source by which voltage supplied to circuit or element is made variable.

Further, the ammeter 114 and the voltage source 105 may be formed over a substrate different from the element substrate formed with the pixel portion 104 or may be formed over an element substrate identical to that of the pixel portion 104 when fabrication thereof is possible.

Further, in the case of a colored display system, the power source and the ammeter may be provided for each color and voltage supplied from the voltage source may be varied for each color.

Further, the light emitting elements 109 of the respective pixels are made to emit light successively and current flowing between the opposed electrodes of the light emitting elements 109 and the power source lines V1 through Vx are successively measured by the ammeter 114. On this occasion, in order to measure an accurate current amount of each pixel, after measuring current, before making a succeeding one of the pixel of the light emitting element emit light, it is necessary to prevent the light emitting element of the measured pixel from emitting light.

That is, the current is measured in a state in which the light emitting element is made to emit light by inputting a video signal for monitoring for making the light emitting element emit light to the pixel and thereafter, a video signal for monitoring for finishing light emittance of the light emitting element is inputted to the pixel to thereby forcibly finish light emittance. Further, the operation is repeated successively for all of the pixels.

Figure 2B:
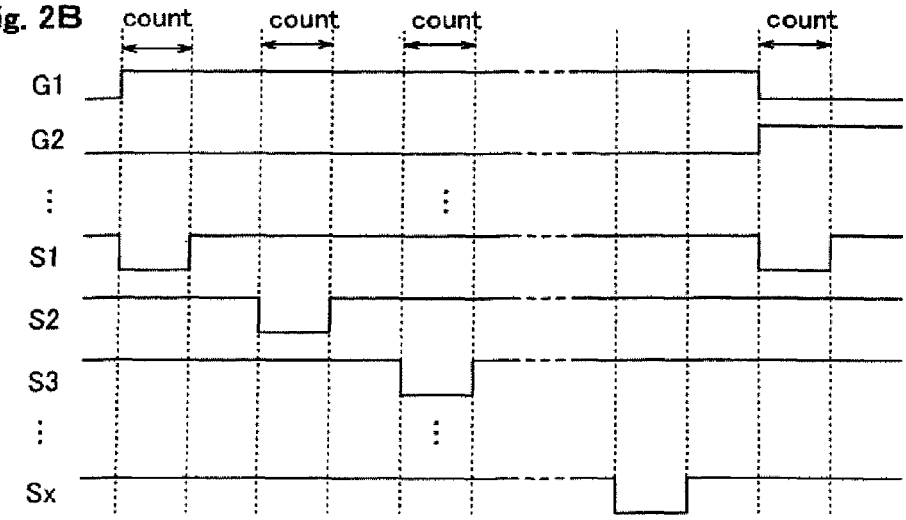

FIG. 2B shows a timing chart of a signal inputted to each wiring of the pixel portion shown in FIG. 2A in monitoring the current. As shown by FIG. 2B, the scanning lines G1 and G2 are successively selected, in a period of selecting each scanning line, voltages for making the light emitting elements emit light and voltages for forcibly finishing light emittance of the light emitting elements are continuously applied successively to the respective signal lines S1 through Sx.

Further, the designer can pertinently determine an order of the pixels for measuring the current and it is necessary to determine voltage of the signal inputted to each wiring in accordance with the order of measuring the pixels.

The current amounts of the respective pixels are successively stored to the volatile memory for pixels 123. Further, when the measurement has partially or totally finished, data of the current amounts of the respective pixel stored to the volatile memory for pixels 123 is stored to the pixel characteristic correcting data storing portion 116 provided to the correcting circuit 100. Further, as for data stored to the pixel characteristic correcting data storing portion 116, data of the current amounts of the respective pixels may be included as information and data of the current amounts of the respective pixels may be regarded to include the dispersion in the characteristic of the driving TFT of each pixel as data.

It is necessary to store the data stored to the pixel characteristic correcting data storing portion 116 continuously even after the power source of the light emitting device is made OFF and therefore, it is preferable to use a nonvolatile memory. A write period of a volatile memory is shorter than that of a nonvolatile memory and a number of times of writing of a nonvolatile memory is generally limited and therefore, it is preferable to carry out storing operation successively by using the volatile memory for pixels 123 in measuring the current and write data to the pixel characteristic correcting data storing portion 116 which is a nonvolatile memory after finishing the measurement partially or totally.

After storing data of the current amount of each pixel to the pixel characteristic correcting data storing portion 116, the volatile memory for pixels 123 and the ammeter 114 are not needed. The volatile memory for pixels 123 and the ammeter 114 may be removed in shipping the light emitting device as a product.

The correcting circuit 100 is provided with a function of correcting a video signal to make gray scales of respective pixels uniform by grasping dispersion of current of each pixel from the data stored to the pixel characteristic correcting data storing portion 116.

Specifically, a current value constituting a reference is predetermined and a video signal is corrected to reduce a number of gray scale of a pixel in which current larger than the current value constituting the reference flows and increase a number of gray scale in a pixel in which current smaller than the current value constituting the reference flows.

Further, the designer can pertinently set which current value is used as the reference for correcting video signals. For example, the reference may be determined by an average value of current amounts of all of the pixels or a certain number of the pixelselected irregularly, or the reference may be determined by the largest or the smallest current amount, or the reference may be determined by a current amount previously determined by calculation. A memory for storing the current value constituting the reference may be separately provided according to which current amount constitutes the reference.

Meanwhile, with regard to the light emitting element used in the light emitting device, data of the change over time of the luminance or data of the change of the luminance relative to the current amount is previously stored in the deterioration characteristic correcting data storing portion 117. The data stored to the deterioration characteristic correcting data storing portion 117 are not limited to these ones and may include information capable of predicting the number of gray scale of each pixel which will be changed by deterioration of the light emitting element in a procedure of using the light emitting device by an end user by comparing the data with information provided from the video signal.

The data stored to the deterioration characteristic correcting data storing portion 117 is used in correcting the voltage supplied from the voltage source 105 to the pixel and a video signal mainly in accordance with a degree of deterioration of the light emitting element of each pixel, although an explanation thereof will be given later.

When necessary data are respectively written to the pixel characteristic correcting data storing portion 116 and the deterioration characteristic correcting data storing portion 117 in this way and a product is completed as a light emitting device, the light emitting device is delivered to the end user and actually displays an image. Next, correction of the video signal when the image is displayed will be explained.

When the video signal is supplied to the light emitting device, the correcting circuit 100 samples the video signal supplied to the light emitting device always or periodically (for example, at each second) and counts information with regard to the number of gray scale of the light emitting period or the current amount of the light emitting element in each element based on information included in the video signal in the counter portion 120. Here, the counted information with regard to the number of gray scale in each pixel is successively stored to a memory as data. Here, it is necessary to accumulate to store the information with regard to the number of gray scale and therefore, it is preferable to use a nonvolatile memory. However, a number of times of writing a nonvolatile memory is generally limited and therefore, as shown by FIG. 1, storing operation may be carried out by using the volatile memory for video signal 121 including a volatile memory in operating the light emitting device and the information may be written to the nonvolatile memory for video signal 122 including a nonvolatile memory at each constant period (for example, at each hour, or on shutting down the power source).

Further, as a volatile memory, a static type memory (SRAM), a dynamic type memory (DRAM) or a ferroelectric memory (FRAM) are cited. However, the invention is not limited thereto but may be constituted by using any type of memory. Similarly, also with regard to a nonvolatile memory, the invention may be constituted by using a nonvolatile memory generally used including a flash memory. However, when DRAM is used for a volatile memory, it is necessary to add a periodically refreshing function.

Data obtained by accumulating information with regard to the number of gray scale of the light emitting period or the current amount stored to the volatile memory for video signal 121 or the nonvolatile memory for video signal 122 is inputted to the video signal correcting circuit 119 and the voltage correcting circuit 118.

The voltage correcting circuit 118 compares data of the change over time of the luminance, data of the change of the luminance relative to the current amount, or the like, which are previously stored to the deterioration characteristic correcting data storing portion 117 with data obtained by accumulating the information with regard to the number of gray scale of each pixel stored to the nonvolatile memory for video signal 122 and grasps a degree of deterioration of each pixel. Further, a specific pixel which is most significantly deteriorated is detected and a value of the voltage supplied from the voltage source 105 to the pixel portion 104 is corrected in accordance with a degree of deterioration of the specific pixel. Specifically, a value of voltage applied to the light emitting element is increased such that the desired gray scale can be displayed in the specific pixel.

The value of the voltage supplied to the pixel portion 104 is corrected in accordance with the specific pixel and therefore, in other pixels which are less deteriorated than the specific pixel, excessively high voltage is supplied to light emitting elements and desired gray scales are not achieved. Hence, in the video signal correcting circuit 119, video signals for determining gray scales of other pixels are corrected. The video signal correcting circuit 119 is inputted with the video signal other than the data obtained by accumulating the information with regard to the number of gray scale of each pixel. The video signal correcting circuit 119 compares the data of the change over time of the luminance or the change of the luminance relative to the current value previously stored to the deterioration characteristic correcting data storing portion 117 with the data obtained by accumulating the information with regard to the number of gray scale of each pixel and grasps the degree of deterioration of each pixel. Further, according to the embodiment, a specific pixel which is most significantly deteriorated is detected and the inputted video signals are corrected in accordance with a degree of deterioration of the specific pixel. Specifically, the video signals are corrected such that desired numbers of gray scale are achieved. The corrected video signals are inputted to the signal line drive circuit 102. Further, as described over, according to the video signal correcting circuit 119, the video signals are corrected such that the dispersion of the current amount of each pixel detected at the time point of fabricating the panel and stored to the pixel characteristic correcting data storing portion 116 is also correct in addition to the over-described correction of deterioration.

Further, the specific pixel is not limited to a pixel which is most significantly deteriorated and may be a pixel which is least deteriorated or an arbitrary pixel determined by the designer. In any pixel to be selected, with the pixel as a reference, the value of the voltage supplied from the voltage source 105 to the pixel portion 104 is determined, at a pixel which is more deteriorated than the specific pixel, the video signal is corrected to increase the number of gray scale and in a pixel which is not deteriorated than the specific pixel, the video signal is corrected to reduce the number of gray scale.

Specifically, in the case of the light emitting device shown in FIG. 2A, the heights of the voltages supplied from the voltage source 105 to the power source line 113 (V1 through Vx) are corrected by the voltage correcting circuit 118. Further, when the video signal is digital, the voltage of the video signal inputted to the pixel is of a binary value and therefore, in order to control the gray scale of the pixel, the video signal is corrected by the video signal correcting circuit 119 such that a period of making the light emitting element 109 emit light is changed. When the video signal is analog, the gray scale of the pixel is controlled by correcting the video signal by the video signal correcting circuit 119 such that a magnitude of drain current of the driving TFT 108 is changed.

FIG. 3A shows a change in the luminance of the light emitting element when the luminance is not corrected. In FIG. 3A, the abscissa designates time in a logarithmic scale and the ordinate designates luminance. It is found that the luminance is reduced by deterioration of the electroluminescent layer with elapse of time.

FIG. 3B shows a change of voltage over time applied to the light emitting element provided to the light emitting device of the invention. The abscissa indicates time in a logarithmic scale and the ordinate indicates voltage applied between the anode and the cathode of the light emitting element. In order to compensate for a reduction in the luminance in accordance with deterioration, voltage applied to the light emitting element is increased.

FIG. 3C shows a change of the luminance over time in the light emitting element provided to the light emitting device of the invention. The abscissa indicates time in a logarithmic scale and the ordinate indicates luminance of the light emitting element. The luminance of the light emitting element is maintained constant by the correction.

Further, although in FIGS. 3B and 3C, the correction is carried out such that the luminance of the light emitting element becomes always constant, for example, when the correction is carried out at each constant period, the correction is carried out when the luminance of the light emitting element is reduced to some degree and therefore, the luminance is not always constant.

Figure 4:
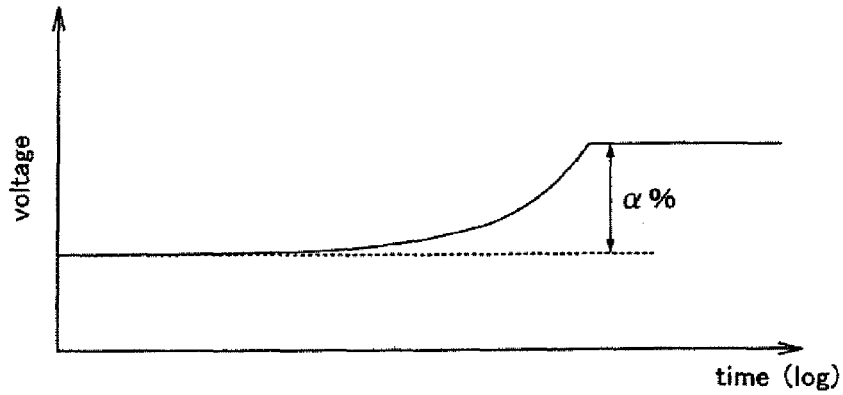
FIG. 4 is a diagram showing a change over time of voltage of light emitting element in a light emitting device of the invention.

Further, when the light emitting element is further deteriorated, voltage applied to the light emitting element is unlimitedly increased. When the voltage applied to the light emitting element becomes excessively large, the light emitting element is accelerated to deteriorate and occurrence of a portion which does not emit light (dark spot) is facilitated. Hence, according to the invention, as shown by FIG. 4, when the voltage applied to the light emitting element is increased by a constant value ($\alpha$%) relative to an initial value thereof, the increase of the voltage by the correction may be stopped and the voltage supplied from the voltage source to the light emitting element may be maintained constant.

Further, the constitution of the light emitting element according to the invention is not limited to the constitution illustrated in FIG. 2A. The voltage applied to the light emitting element may be controlled by the voltage source.

Further, according to the light emitting element of the invention, data stored to the volatile memory for video signal 121 may be added to data stored to the nonvolatile memory for video signal 122 to store on shutting down the power source. Thereby, after making the power source ON at the next time, the light emitting period or data accumulated with the number of gray scale of the light emitting element is continuously collected.

As described over, by sampling the video signal always or periodically and storing the data obtained by accumulating the information with regard to the number of gray scale of each pixel, the video signal is corrected at each time by comparing the data obtained by accumulating the information, with the data of the change of the luminance over time or the data of the change of the luminance relative to the current amount, which are previously stored, and the video signals can be corrected such that in a deteriorated light emitting element, luminance equivalent to a light emitting element which is not deteriorated can be achieved. Therefore, uniformity of the screen can be maintained without bringing about nonuniformity of the luminance.

Further, after fabricating the panel, by grasping a dispersion of current flowing in the light emitting element of each pixel by measurement and correcting the video signal such that gray scale of each pixel is made uniform, a nonuniformity in the luminance among pixels which has been brought about before the deterioration is progressed can be restrained.

Further, except for detecting the light emitting period or the number of gray scale of the light emitting element, only presence or absence of light emittance of the light emitting element at a certain time point may be detected. Further, it is possible to estimate the degree of deterioration of the light emitting element from a rate of a number of times of emitting light as compared with a total number of times of detection by increasing a number of times of detecting presence or absence of emitting light.

Figure 5:
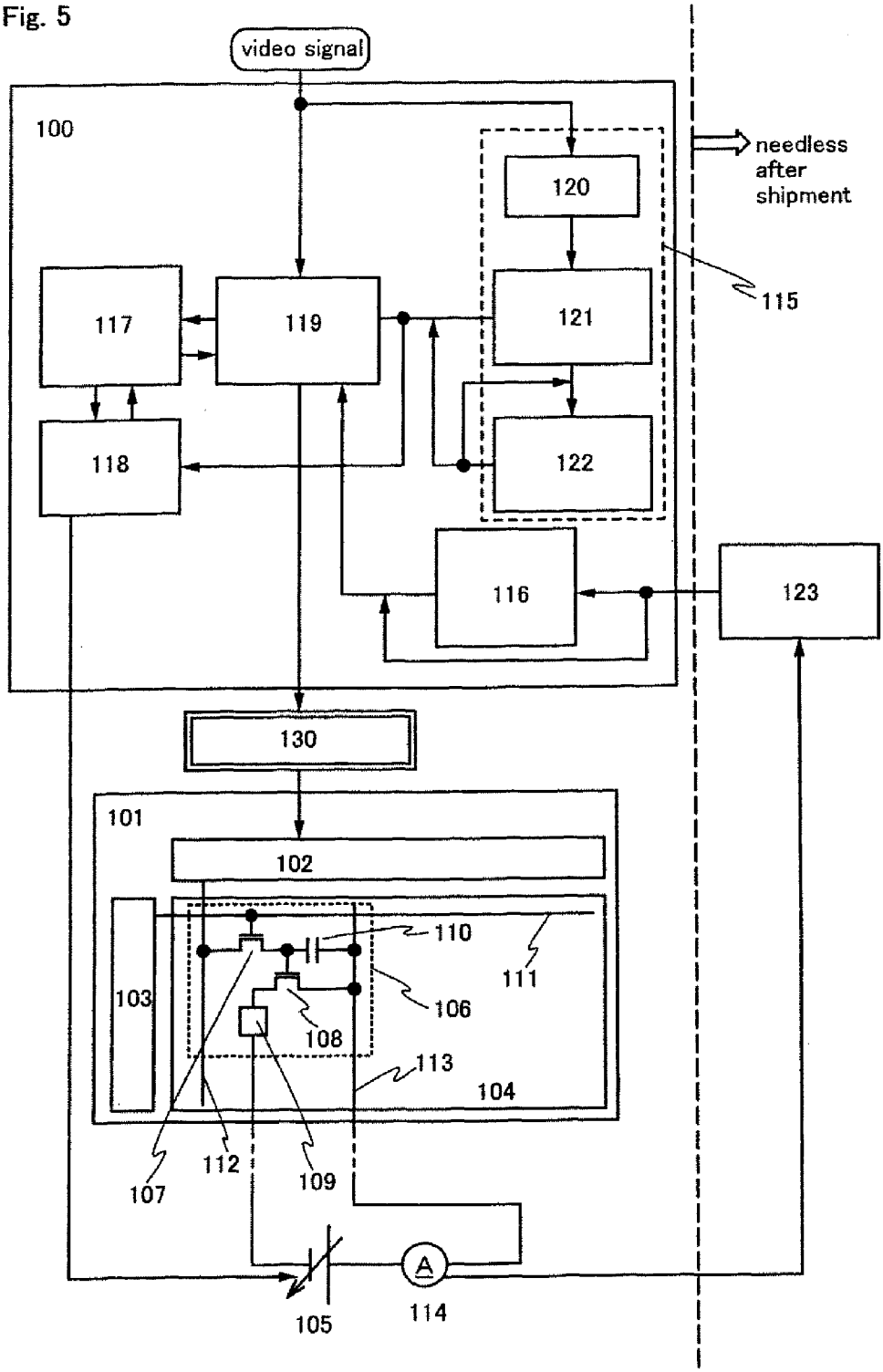
FIG. 5 is a block diagram of a light emitting device of the invention.

Further, although in FIG. 1, the corrected video signal is inputted to the signal line drive circuit directly, when the signal line drive circuit corresponds to an analog video signal, as shown by FIG. 5, the digital video signal may be converted to the analog video signal to input by providing a D/A conversion circuit.

In the case of the panel driven by using the analog video signal, by obtaining data including the amount of current flowing to the light emitting element of each pixel by sampling the video signal, the degree of deterioration of the light emitting element can be estimated based on the data.

Although as described over, an explanation has been given by taking an example of the light emitting element using OLED, the light emitting device of the invention is not limited to OLED but other light emitting element of PDP or FED may be used.

Embodiment 2

According to Embodiment 1, an explanation has been given with regard to an example of grasping the dispersion of the characteristics of the driving TFTs by using data of the current amount of each pixel and making the gray scales of pixels uniform. The current flowing in the light emitting element and the luminance are in a proportional relationship and therefore, the dispersion of the luminance of the light emitting element may be regarded as the dispersion of flowing current. Therefore, the gray scale of each pixel can also be corrected by using data of the luminance of each pixel instead of data of the current amount of each pixel. According to the embodiment, an explanation will be given with regard to an example of making the gray scale of pixels uniform by using data of the luminance of pixels instead of data of the current amount of each pixel.

Figure 19A:
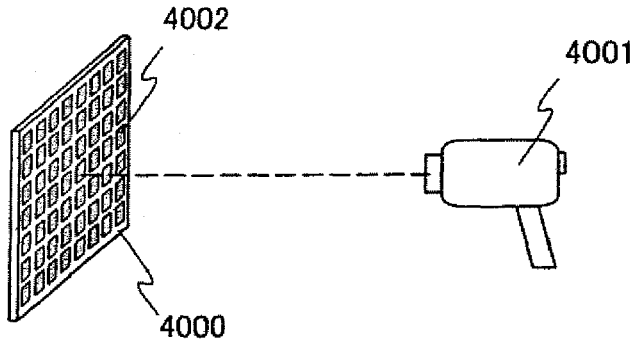
FIGS. 19A, 19B and 19C are views showing methods of measuring luminance.

There are various methods of measuring the luminance of the light emitting element. FIG. 19A shows an example of measuring the luminance by using a luminance meter. Numeral 4000 designates a panel having a pixel 4002 provided with a light emitting element and luminance of each pixel 4002 is measured by a luminance meter 4001.

Figure 19B:
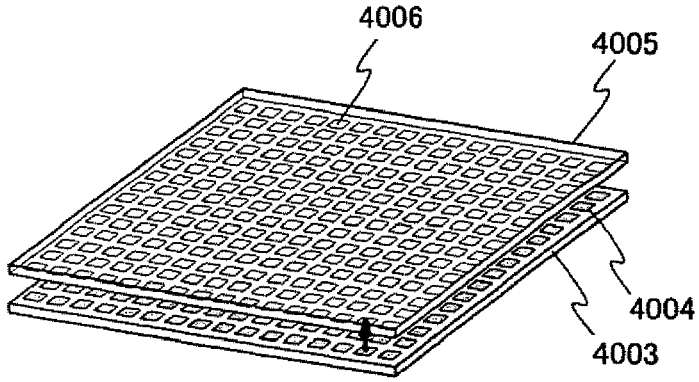

FIG. 19B shows an example of measuring luminance by using an area sensor. A panel 4003 includes a pixel 4004 provided with a light-emitting element. Further, an area sensor 4005 includes a light receiving element 4006 in correspondence with each pixel. Further, luminance of each pixel can be measured by overlapping the panel 4003 and the area sensor 4005 such that a pixel 4004 and a light receiving element 4006 overlap to correspond to each other.

Figure 19C:
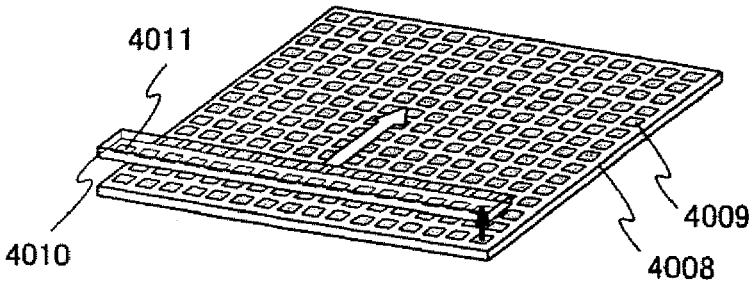

FIG. 19C shows an example of measuring luminance by using a line sensor. A panel 4008 includes a pixel 4009 provided with a light emitting element. Further, a line sensor 4010 includes a light receiving element 4011 aligned in a shape of a line. Further, by scanning the line sensor 4010 over the panel 4008, the pixel 4009 and the light receiving element 4011 can be made to overlap to correspond to each other and luminance of each pixel can be measured.

Data of luminance of each pixel is stored to a pixel characteristic correcting data storing portion. According to the embodiment, an ammeter for measuring current of each pixel is not needed. A video signal correcting circuit is provided with a function of grasping a dispersion in gray scale of each pixel by using data stored to the pixel characteristic correcting data storing portion and correcting a video signal such that gray scale of each pixel is made uniform.

Figure 20A:
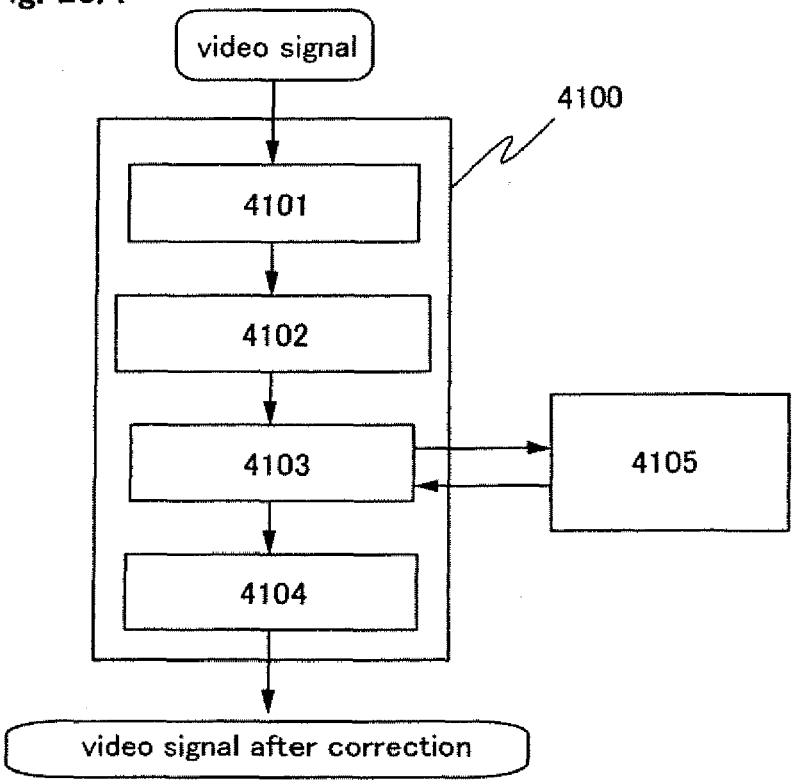
FIGS. 20A and 20B are diagrams showing a constitution of a video signal correcting circuit.
Figure 20B:
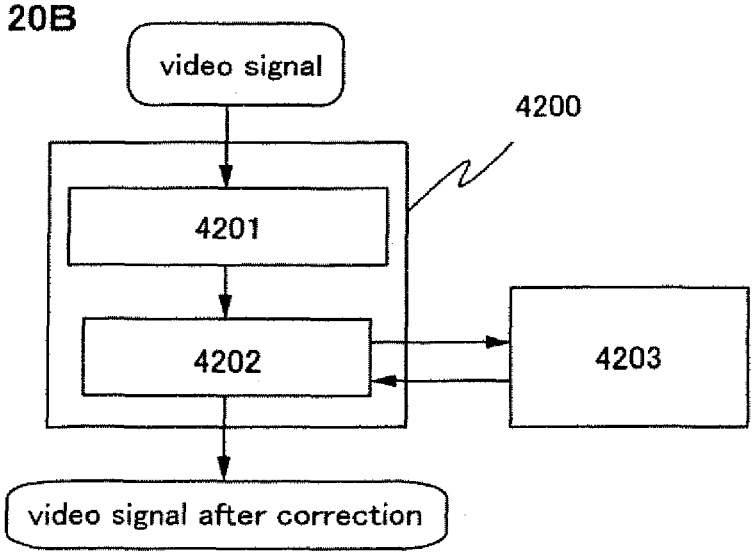
Figure 21:
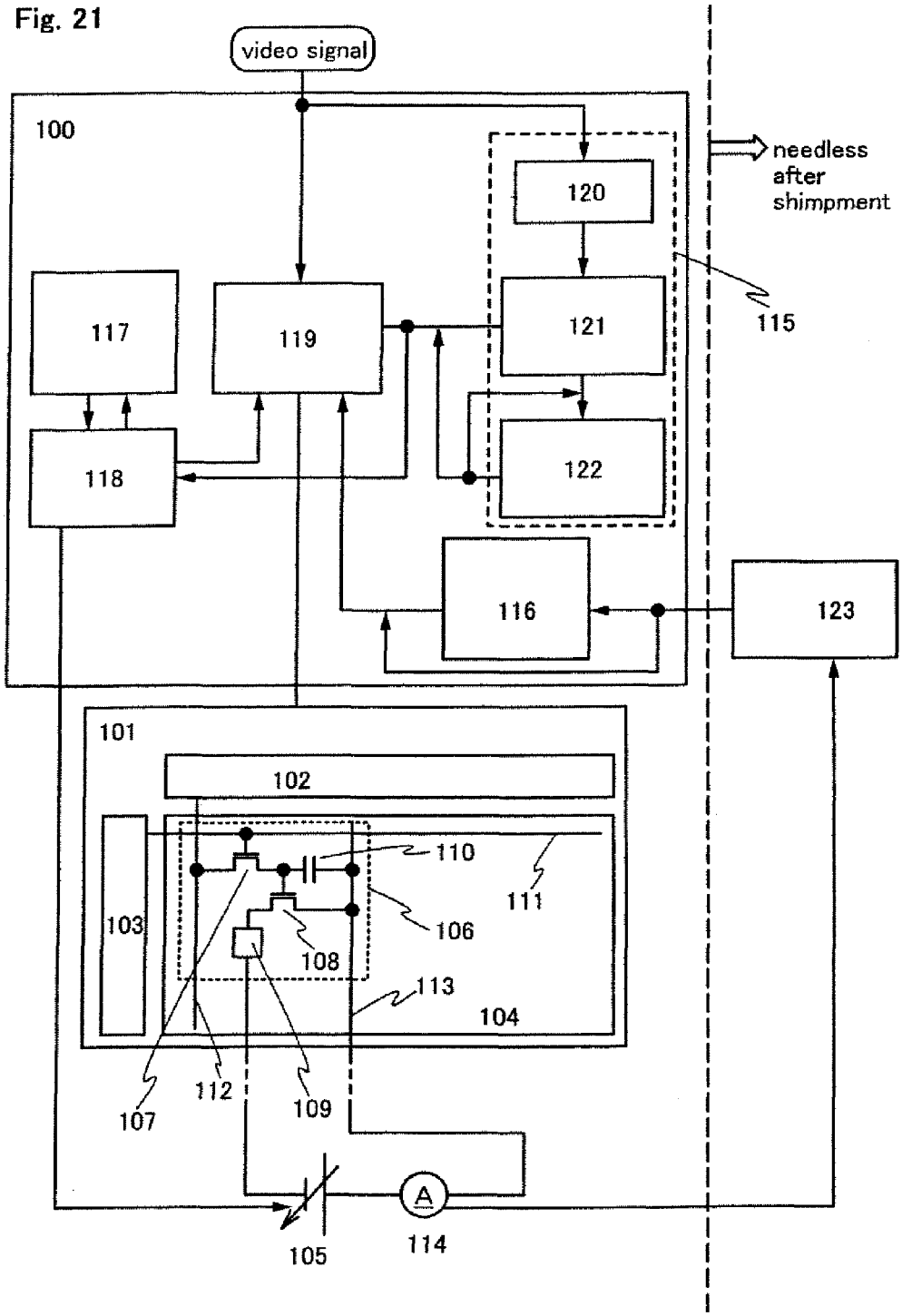
FIG. 21 is a block diagram of a light emitting device of the invention.

FIGS. 20A and 20B show a constitution of a video signal correcting circuit as an example. FIG. 20A shows a block diagram of a video signal correcting circuit for correcting an analog video signal. An analog video signal inputted to a video signal correcting circuit 4100 is converted into a digital signal by an A/D conversion circuit 4101 and stored to a memory for video signal 4102. In an arithmetic circuit 4103, by using data of luminance of each pixel stored to an image characteristic correcting data storing portion 4105, a video signal which is made digital stored to the memory for video signal 4102 is corrected such that luminance of each pixel is made uniform.

The corrected video signal is converted into an analog signal in a D/A conversion circuit 4104 and supplied to a signal line drive circuit. By the corrected video signal, a dispersion in luminance among pixels caused by a dispersion of a characteristic in a driving TFT of each pixel can be reduced.

Specifically, a luminance constituting a reference is previously determined and the video signal is corrected such that a number of gray scale is increased for a pixel having a luminance higher than the luminance constituting a reference and increase the number of gray scale for a pixel having a luminance lower than the luminance constituting a reference.

FIG. 20B shows a block diagram of a video signal correcting circuit for correcting a digital video signal. A digital video signal inputted to a video signal correcting circuit 4200 is stored to a memory for video signal 4201. In an arithmetic circuit 4202, by using data of luminance of each pixel stored to a pixel characteristic correcting data storing portion 4203, the digital video signal stored to the memory for video signal 4201 is corrected such that luminance of each pixel is made uniform.

The corrected video signal is supplied to a signal line drive circuit. A dispersion of luminance among pixels caused by a dispersion of characteristics of driving TFTs of pixels is reduced by the corrected video signal.

Specifically, a luminance constituting a reference is previously determined and the video signal is corrected such that a number of gray scale is reduced for a pixel having a luminance higher than the luminance and the number of gray scale is increased for a pixel having a luminance lower than the luminance.

Further, a designer can pertinently set by which luminance the video signals are corrected as the reference. For example, the reference may be constituted by an average value of luminance of all of pixels or a certain number of pixelselected irregularly, the reference may be determined by a highest or a lowest luminance or the reference may be determined by a luminance previously determined by calculation. A memory for storing data of luminance constituting the reference may separately be provided in accordance with which luminance constitutes the reference.

Further, the luminance may be measured by using a video signal having a specific one of gray scale as information or the luminance may be measured for each gray scale by using a video signal having a plurality or a total of respective gray scales as information. In the former case, in an arithmetic circuit, the video signal can be corrected by simply adding or reducing a determined number of gray scales in accordance with data of the luminance. Therefore, measurement of the luminance is further facilitated and a capacity of a memory used as the pixel characteristic correcting data storing portion can be reduced. Further, in the latter case, the relationship between the video signal and the luminance can be grasped further accurately and therefore, the gray scale of each pixel can be further uniformly.

Embodiment 3

In embodiment 1, both the voltage correcting circuit 118 and the video signal correcting circuit 119 compare data of the change over time of the luminance, data of the change of the 5, luminance relative to the current amount, or the like, which are previously stored to the deterioration characteristic correcting data storing portion 117 with data obtained by accumulating the information with regard to the number of gray scale of each pixel stored to the nonvolatile memory for video signal 122 and grasp a degree of deterioration of each pixel.

An explanation with regard to a structure different from Embodiment 1 will be given in this Embodiment. In this Embodiment, in the video signal correcting circuit 119, video signals are corrected by the data with regard to the degree of deterioration of each pixel obtained in the voltage correcting circuit 118.

By the above structure, in the video signal correcting circuit 119, it is omitted to compare data of the change over time of the luminance, data of the change of the luminance relative to the current amount, or the like, which are previously stored to the deterioration characteristic correcting data storing portion 117 with data obtained by accumulating the information with regard to the number of gray scale of each pixel stored to the nonvolatile memory for video signal 122 and to grasp a degree of deterioration of each pixel, thereby to be able to improve the operation efficiency of the correcting circuit 100.

EXAMPLES

Examples of the invention will be described as follows.

Example 1

According to the example, a flow of a production system of the invention will be explained. Further, there is a case in which a correcting circuit is fabricated to be included over a panel along with a pixel portion and there is a case of fabricating a separate correcting circuit over a separate substrate and mounting the correcting circuit over a panel thereafter.

Figure 6:
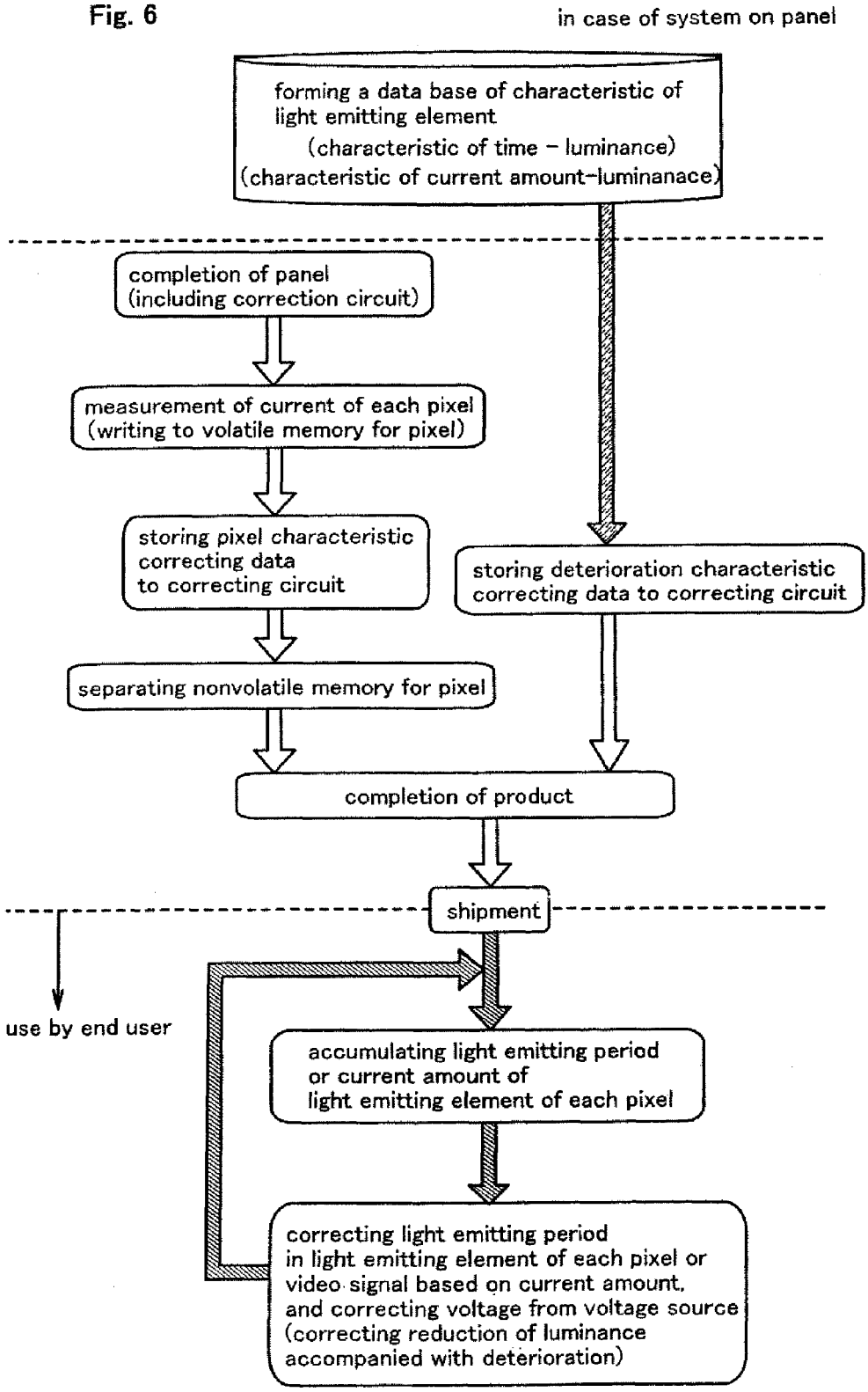
FIG. 6 is a flowchart of a production system of the invention.

FIG. 6 shows a flowchart of a production system of the invention when a correcting circuit is fabricated to be included over a panel. In this case, the correcting circuit may be regarded as a portion of the panel. After completing the panel including the correcting circuits light emitting elements of respective pixels are successively lighted and current values flowing in the light emitting elements are measured. A measured current value includes dispersion in characteristics of driving TFTs of pixels as information. Further; data including the measured current values as information (herein after, referred to as characteristic correcting data) are successively written to a volatile memory for pixels.

Further, the data including the current values as information are not necessarily required to be values of current per se and may be information including a relative dispersion of current values among pixels in some form.

Further, when the characteristic correcting data has written to the volatile memory for pixels to some degree, the characteristic correcting data is written from the volatile memory for pixels to a correcting circuit. Specifically, the characteristic correcting data is written to a pixel characteristic correcting data storing portion formed from a nonvolatile memory inside the correcting circuit.

When the characteristic correcting data has completely been written to the pixel characteristic correcting data storing portion, the volatile memory for pixels is not needed. In case that the volatile memory keeps to be mounted thereafter, small-sized formation of the panel is hampered. Therefore, it is preferable to separate the volatile memory for pixels.

Meanwhile, when a material of an electroluminescent layer and a constitution of the layer of a light emitting element is determined, a data base of a characteristic of the light emitting element is formed. In the light emitting element, the electroluminescent materials used in the light emitting layers may differ depending on colors. When different electroluminescent materials are used or a structure of the electroluminescent layers differ, it is preferable to form a data base of characteristics of the light emitting elements for respective constitutions.

As the characteristic of a light emitting element, a value of luminance relative to a light emitting period (time) of the light emitting element or a value of luminance relative to an amount of current flowing in the light emitting element can specifically be used. Further, the characteristics are not limited to the ones described over and any characteristic can be used so far as a reduction in luminance by deterioration of each pixel can be predicted by referring to a video signal.

Further, the data base of the characteristic of the light emitting element may be formed by a maker fabricating the panel or an existing data base may be acquired and used. The data with regard to the characteristics of the light emitting elements are stored to the correcting circuit as deterioration characteristic correcting data. Specifically, the data is stored to a deterioration characteristic correcting data storing portion formed from a nonvolatile memory provided to the correcting circuit.

Further, when the light emitting device is completed, the device is shipped as a product and is brought into a state of being able to be used by an end user. A flow until completed as the product is included in the production system of the invention.

When the light emitting device is used by the end user, the video signal is corrected in reference to the characteristic correcting data in the pixel characteristic correcting data storing portion and nonuniformity of luminance among pixels caused by the dispersion of the characteristics of the driving TFTs is always corrected.

Further, by monitoring the video signal, data capable of predicting the degree of deterioration, such as a light emitting period or a current value of the light emitting element at each pixel, are accumulated. Further, from the accumulated data to be able to predict the degree of deterioration and the deterioration characteristic correcting data in the deterioration characteristic correcting data storing portion, the degree of deterioration of the light emitting element of each pixel is predicted and the video signals are corrected such that nonuniformity of luminance among pixels caused by the dispersion in the deterioration of the light emitting elements are corrected.

Figure 7:
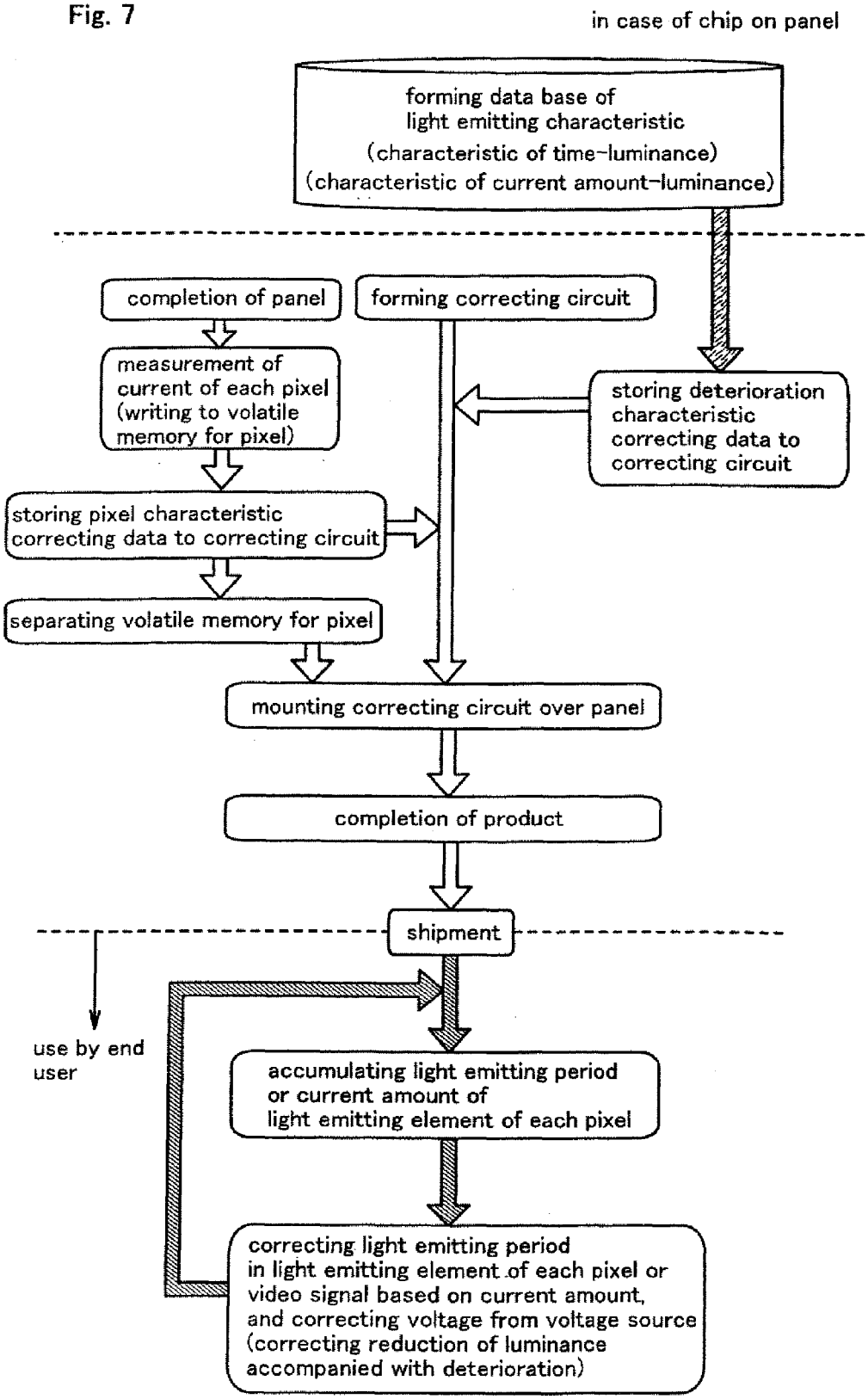
FIG. 7 is a flowchart of a production system of the invention.

Next, FIG. 7 shows a flowchart of a production system of the invention when the correcting circuit is fabricated separately and mounted to the panel thereafter. First, after completing the panel, light emitting elements of respective pixels are successively lighted and characteristic correcting data provided by measuring current flowing in the light emitting elements are successively written to the volatile memory for pixels.

Meanwhile, the correcting circuit is fabricated separately from the panel.

Further, when the characteristic correcting data has been written to the volatile memory for pixels to some degree, the characteristic correcting data are written from the volatile memory for pixels to the correcting circuit. Specifically, the data are written to the pixel characteristic correcting data storing portion formed using the nonvolatile memory inside the correcting circuit.

When the characteristic correcting data has been completely written to the pixel characteristic correcting data storing portion, the volatile memory for pixels is not needed, when the volatile memory keeps to be mounted thereafter, small-sized formation of the panel is hampered. Therefore, it is preferable to separate the volatile memory for pixels.

Meanwhile, the database of the characteristics of the light emitting elements is formed. The database of the characteristics of the light emitting elements may be formed by a maker fabricating the panel or existing data base may be acquired and used. The data with regard to the characteristics of the light emitting elements are stored to the correcting circuit as the deterioration characteristic correcting data. Specifically, the data are stored to the deterioration characteristic correcting data storing portion formed using the nonvolatile memory provided to the correcting circuit.

Further, the correcting circuit is mounted to the panel. Further, the correcting circuit may be mounted to the panel before storing the deterioration characteristic correcting data or before storing the pixel characteristic correcting data.

Further, when the light emitting device is completed, the device is shipped as a product and is brought into a state of being able to be used by the end user. The flow until completing the device as the product is included in the production system of the invention.

Further, by separately fabricating the correcting circuit, the yield of the light emitting device can be increased. Further, by fabricating the correcting circuit so as to be included in the panel, the size of the light emitting device can be reduced.

Example 2

In this example, description is made on a method for correcting a video signal which is adopted to a correction circuit of a light emitting device of the present invention.

In one approach to correct the decreased luminance of a deteriorated light emitting element on the basis of a video signal, a given correction value is added to an input video signal to convert the input signal to a signal practically representing a gray scale increased by several steps thereby achieving a luminance equivalent to that prior to the deterioration. The simplest way to implement this approach in circuit design is to provide a circuit in advance which is capable of processing data on an extra gray scale.

Specifically, in the case of a light emitting device adapted for 6-bit digital gray scales (64 gray scales) and including the deterioration correction function of the invention, for example, the device is so designed and manufactured as to have an additional capability of processing an extra 1 bit data for performing the correction and to practically process 7-bit digital gray scales (128 gray scales). Then, the device operates on the lower order 6-bit data in normal operation. When the deterioration of the light emitting element occurs, the correction value is added to the normal video signal and the aforesaid extra 1-bit is used for processing the signal of the added value. In this case, MSB (most significant bit) is used for the signal correction alone so that practically displayed gray scale includes 6 bits.

The present example can be freely implemented with being combined with Example 1.

Example 3

In this example, description is made on a method for correcting the video signal in a different way from that of Example 2.

Figure 8A:
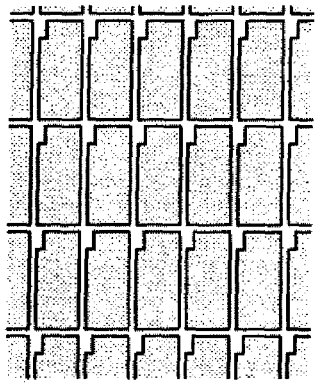
FIGS. 8A, 8B and 8C are diagrams showing a correcting method by an adding processing.

FIG. 8A is an enlarged view showing a part of a pixel portion and a plurality of pixels are arranged in the pixel portion. FIG. 8A shows a state of the pixels immediately after starting an application of an end user, and also shows a state in which nonuniformity of luminance among the pixels caused by dispersion of characteristics of the driving TFTs are dissolved.

Figure 8B:
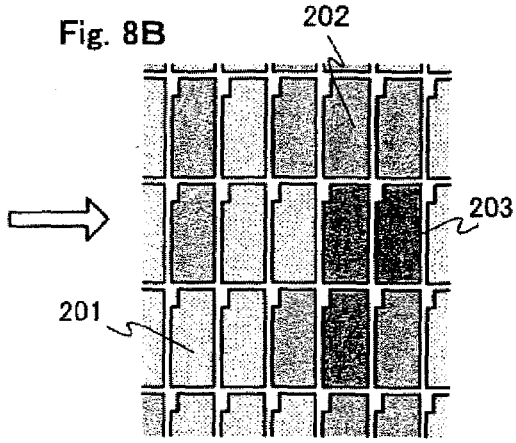

As use by the end user is repeated, degrees of deterioration of light emitting elements become different between the pixels, thereby occurring the luminance irregularities. This state is shown in FIG. 8B. Here, three pixels 201 to 203 are discussed. It is assumed that the pixel 201 suffers the least deterioration, the pixel 202 suffering a greater deterioration than the pixel 201, the pixel 203 suffering the greatest deterioration.

The greater the deterioration of the pixel, the greater the decrease of luminance of the pixel. Without the correction of luminance, the pixels, which are displaying a certain half tone, will encounter luminance variations as shown in FIG. 8B. That is, the pixel 202 presents a lower luminance than the pixel 201 whereas the pixel 203 presents a much lower luminance than the pixel 201.

Next, actual correction operations are described. Measurement is previously taken to obtain a relation between the accumulative data on the light emitting periods or gray scales of the light emitting element and the decrease in the luminance thereof due to deterioration. It is noted that the accumulative data on the light emitting periods or gray scales and the decrease in the luminance of the light emitting element due to deterioration do not always present a monotonous relation. The degrees of deterioration of the light emitting element versus the accumulative data on the light emitting periods or gray scales are stored in the correction data storage portion in advance.

The voltage correction circuit 118 determines a correction value for the voltage supply from the voltage source 105 based on the data stored in the deterioration characteristic correcting data storing portion 117. The correction value for the voltage is determined based on the accumulative data on the light emitting periods or gray scales of a reference pixel. If the pixel 203 with the greatest deterioration is used as reference, for example, the pixel 203 is allowed to attain a desired gray scale but the pixels 201 and 202 are applied with excessive voltages so that a video signal therefore requires correction. Thus, the video signal correction circuit 119 so corrects the input video signal as to achieve the desired gray scales based on the degree of deterioration of the particular pixel having the greatest deterioration. Specifically, the accumulative data on the light emitting periods or gray scales are compared between the reference pixel and another pixel; a difference between the gray scales of these pixels is calculated; and the video signal is so corrected as to compensate for the gray scale difference.

The video signal correction circuit 119 decides a correction value for each video signal by comparing the input video signals with accumulative data on the light emitting periods or gray scales of each of the pixels.

In a case where the correction is performed using the pixel 203 as reference, for example, the pixels 201 and 202 differ from the pixel 203 in the degree of deterioration, thus requiring the correction of the gray scales by way of the video signal. It is expected from the accumulative data on the light emitting periods or gray scales of these pixels that the pixel 201 has a greater difference from the pixel 203 in the degree of deterioration than the pixel 202 does. Hence, the gray scale of the pixel 203 is corrected by a greater number of steps as compared with the correction for the pixel 202.

Figure 8C:
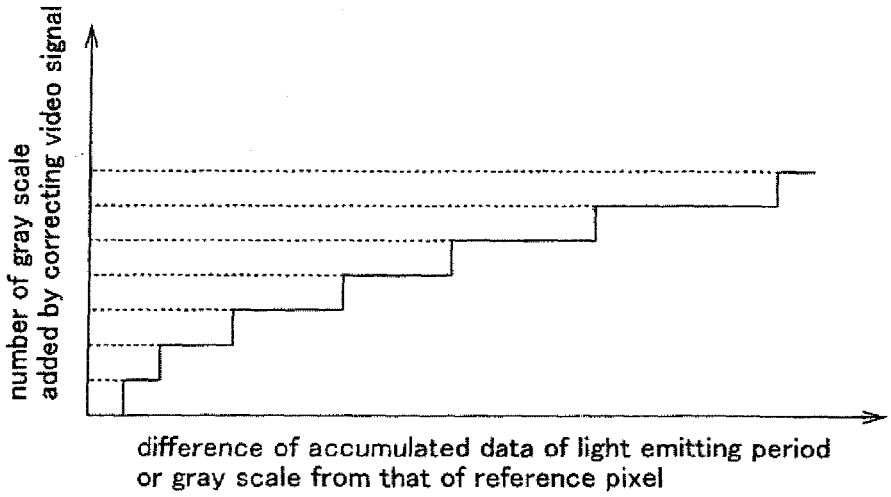

FIG. 8C graphically shows a relation between the difference from the reference pixel in the accumulative data on the light emitting periods or gray scales and the number of gray scales corrected by way of the video signal. It is noted that since the accumulative data on the light emitting periods or gray scales and the decrease in the luminance of the light emitting element due to deterioration do not always have a monotonous relation, the number of gray scales to be added by the correction of the video signal does not always present a monotonous relation relative to the accumulative data on the light emitting periods or gray scales. As described above, the correction based on the adding operation assures the consistent luminance of screen.

Figure 9:
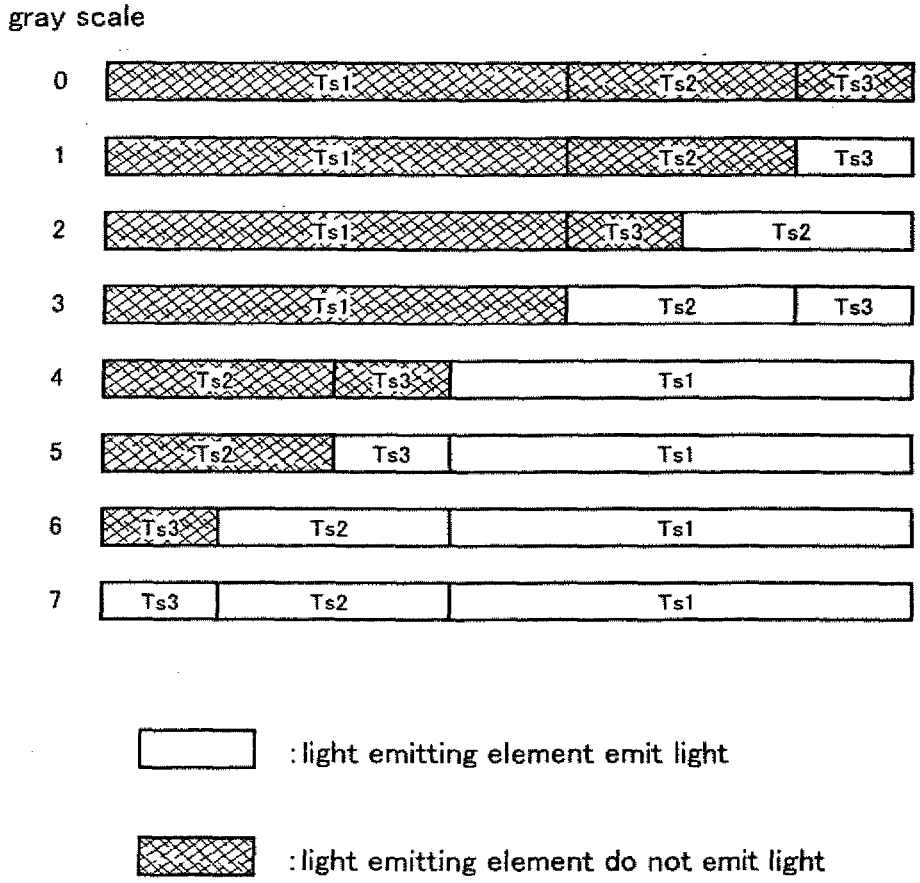
FIG. 9 is a view showing a relationship between a number of gray scale and a luminescent period.

Now referring to FIG. 9, description is made on a relation between the respective lengths of the light emitting periods (Ts) of the light emitting elements corresponding to the respective bits of the video signals and the gray scale of the light emitting device of the invention. FIG. 9 takes an example where the video signal includes 3 bits and illustrates the durations of light emissions appearing in one frame period for displaying each of the 8 gray scales of 0 to 7.

The individual bits of the 3-bit video signals correspond to three light emitting periods Ts1 to Ts3, respectively. The arrangement of the light emitting periods is expressed as Ts1:Ts2:Ts3=$2^2$:2:1. Although the example is explained by way of the example of the 3-bit video signal, the number of bits is not limited to this. In a case where an n-bit video signal is used, the ratio of the lengths of the light emitting periods is expressed as Ts1:Ts2: . . . :Ts (n−1): Tsn=$2^{n-1}$:$2^{n-2}$: . . . :2:1.

The gray scale is determined by the sum of the lengths of the durations of light emissions appearing in one frame period. In a case where the light emitting elements are emitting light for all the light emitting periods, for example, the gray scale is at 7. Where the light emitting elements do not emit light for all the light emitting periods, the gray scale is at 0.

It is assumed that the voltage is corrected in order to permit the pixels 201, 202 and 203 to display a gray scale 3, but that the pixel 203 achieves the gray scale 3 where as the pixel 201 displays a gray scale 5 and the pixel 202 displays a gray scale 4. In this case, the gray scale of the pixel 201 is higher by 2, whereas the gray scale of the pixel 202 is higher by 1.

Thus, the video signal correction circuit corrects the video signal to apply the pixel 201 with a corrected video signal of a gray scale 1 which is lower than the desired gray scale of 3 by 2, such that the light emitting element thereof may emit light only for the period of Ts3. On the other hand, the video signal correction circuit corrects the video signal to apply the pixel 202 with a corrected video signal of a gray scale 2 lower than the desired gray scale of 3 by 1, such that the light emitting element thereof emits light only for the period of Ts2.

Although this example illustrates the case where the correction is performed using the pixel with the greatest deterioration as reference, the invention is not limited to this. The designer may arbitrarily define the reference pixel and may arrange such that the video signal is corrected appropriately to accomplish coincidence of the gray scale with that of the reference pixel.

In a case where a pixel with the least deterioration is used as reference, the video signal is corrected based on the adding operation so that there is a disadvantage that the correction on the display of white is ineffective (Specifically, when "111111" is inputted as a 6-bit video signal, for example, any further adding operation cannot be done). On the other hand, in a case where a pixel with the greatest deterioration is used as reference, the video signal is corrected based on subtracting operation. In contrast to the correction based on adding operation, an ineffective range of correction is for the display of black and hence, there is little influence (Specifically, when 000000 is inputted as a 6-bit video signal, any further subtracting operation is not needed and an exact display of black can be accomplished by a normal light emitting element and a deteriorated light emitting element (simply by placing the light emitting elements in a non-emission state). The method has a feature that range gray scales higher than 0 by several steps neighboring black can be substantially adequately displayed if display data of a somewhat large number of bits are adapted to a display unit). Both the methods are useful for increasing the number of gray scales.

In an another effective approach, both the correction method based on adding operation and the correction method based on subtracting operation are used in combination as switched at a given gray scale as boundary, for example, thereby compensating each other for the respective demerits thereof.

It should be note that it is possible to correct the gray scale by combining a correction of the light emitting period and a correction of amount of current flown in the light emitting element.

The present invention can be freely implemented by being combined with Example 1.

Example 4

In Example 4, the following description refers to the configurations of a signal line drive circuit and a scanning line drive circuit provided for the light emitting device of the present invention.

Figure 10A:
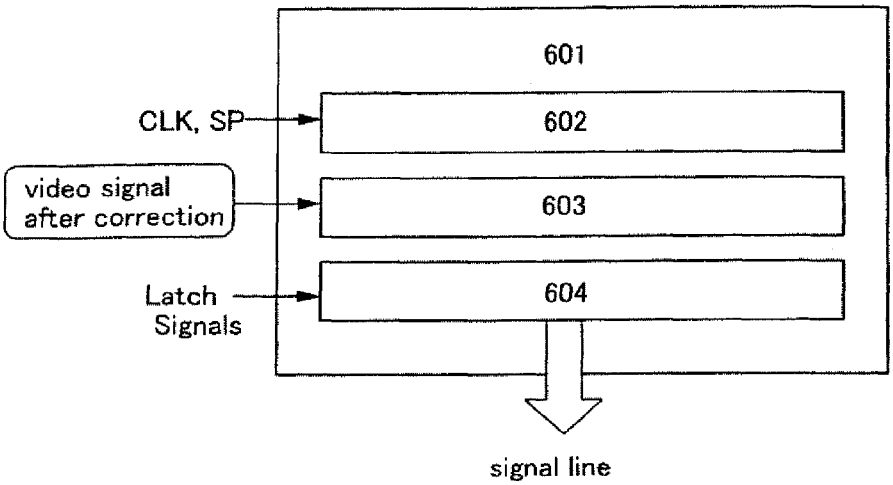
FIGS. 10A and 10B are block diagrams of a drive circuit of a light emitting device of the invention.
Figure 10B:
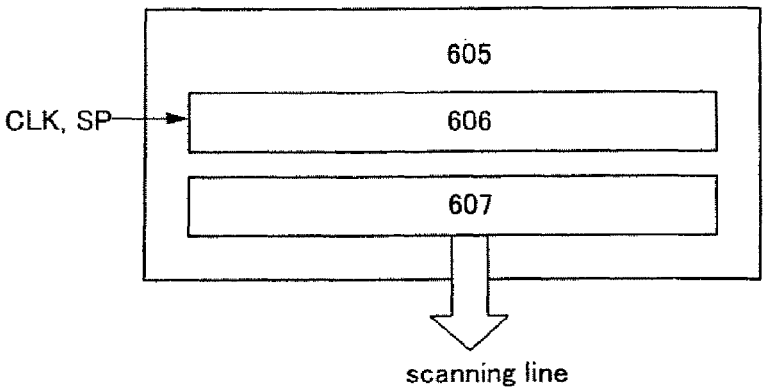

The block diagram of a drive circuit in a light emitting device with respect to this example is shown in FIGS. 10A and 10B. FIG. 10A shows the signal line drive circuit 601 which process a digital video signal and has a shift register 602, latch A of 603 and latch B of 604.

A clock signal (CLK) and a start pulse (SP) are input to the shift register 602 in the signal line drive circuit 601. The shift register 602 generates timing signals in order based upon the clock signal (CLK) and the start pulse (SP), and supplies the timing signals one after another to the subsequent stage circuit through the buffer (not illustrated) and the like.

Note that, the timing signals output from the shift register circuit 602 may be buffer amplified by a buffer and the like. The load capacitance (parasitic capacitance) of a wiring to which the timing signals are supplied is large since many of the circuits or elements are connected to the wiring. The buffer is formed in order to prevent bluntness in the rise and fall of the timing signal, caused by the large load capacitance. In addition, the buffer is not necessarily provided.

The timing signal buffer amplified by a buffer is inputted to the latch A of 603. The latch A of 603 has a plurality of latch stages for processing corrected video signals in a correction circuit. The latch A 603 gradually reads in and maintains the corrected video signals input from the correction circuit, when the timing signal is input.

Note that the video signals may also be input in order to the plurality of latch stages of the latch A of 603 in reading in the video signals to the latch A of 603. However, the present invention is not limited to this structure. The plurality of latch stages of the latch A of 603 may be divided into a certain number of groups, and the video signals may be input to the respective groups at the same time in parallel, performing partitioned driving. Also, the number of the stages included in one group is referred to as dividing number. For example, when the latches are divided into groups by every four stages, it is referred to as partitioned driving with 4 divisions.

The period during which the video signals are completely written into all of the latch stages of the latch A of 603 is referred to as a line period. In practice, there are cases in which the line period includes the addition of a horizontal retrace period to the above-mentioned line period.

After one line period is completed, the latch signal is inputted to the latch B of 604. At the moment, the video signals written into and stored in the latch A of 603 are sent all together to be written into and stored in all stages of the latch B of 604.

After completing sending the digital video signal to the latch B of 604, it is performed to write the digital video signal into the latch A of 603 in accordance with the timing signal from the shift resister 602. In the second ordered one line period, the digital video signals that are written into and stored in the latch B of 604 are inputted to a signal line.

In place of a shift register, it is also practicable to utilize a different circuit such as a decoder circuit by which video signals are serially written to the latch circuits.

FIG. 10B exemplifies a block diagram of a scanning line drive circuit comprising a shift register 606 and a buffer circuit 607. If deemed necessary, a level shifter may also be provided.

In the scanning line drive circuit 605, the timing signal from the shift register 606 is input to the buffer circuit 607 and successively input to a corresponding scanning line. A plurality of gates of those TFTs functioning as switching elements included in pixels corresponding one-line are connected to individual scanning lines. Since it is required to simultaneously turn ON a plurality of TFTs included in pixels corresponding to one line, the buffer circuit 607 is needed to be capable of flowing a large current.

In place of a shift register, it is also practicable to utilize a different circuit such as a decoder circuit to select gate signals and provide timing signals.

Next, a configuration of a signal line drive circuit for processing an analog video signal will be described.

Figure 11:
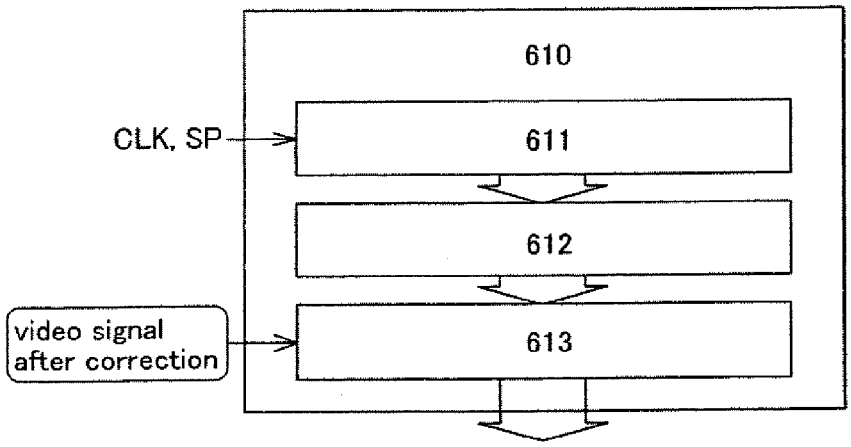
FIG. 11 is a block diagram of a signal line drive circuit of a light emitting device of the invention.

FIG. 11 shows a block diagram of the signal line drive circuit for processing an analog video signal. A signal line drive circuit 610 includes a shift register 611, a level shifter 612, and a sampling circuit 613. Incidentally, although the level shifter 612 is provided between the shift register 611 and the sampling circuit 613 in FIG. 11, the level shifter 612 may be incorporated in the shift register 611.

A timing signal for controlling the timing for sampling a video signal is generated in the shift register 611 when a clock signal (CLK) and a start pulse signal (SP) are provided in the shift register 611. The generated timing signal is supplied to the level shifter 612. In the level shifter 612, amplitude of a voltage of the supplied timing signal is amplified.

The timing signal amplified in the level shifter 612 is inputted in the sampling circuit 613. Then, the video signal corrected in the correction circuit is sampled synchronizing with the timing signal inputted in the sampling circuit 613 and is inputted in the pixel portion via the signal line.

The configuration of the drive circuit utilized in the present invention is not solely limited to the one shown in Example 4. The configuration based on this example may also be realized by being freely combined with Examples 1 to 3.

Example 5

When a correcting circuit is formed over a substrate the same as that of a pixel portion, a signal line drive circuit and a scanning line drive circuit, low cost formation, compact formation and high speed drive can be realized by considerably reducing a number of parts. Meanwhile, when the correcting circuit is formed over a substrate different from that of the pixel portion, a video signal supplied to a light emitting device is corrected by the correcting circuit and thereafter inputted to the signal line drive circuit formed over a substrate the same as that of the pixel portion via FPC. By such method, there is achieved an advantage that there is compatibility by unitized formation of the correcting circuit and a general panel can be used as it is.

Figure 12:
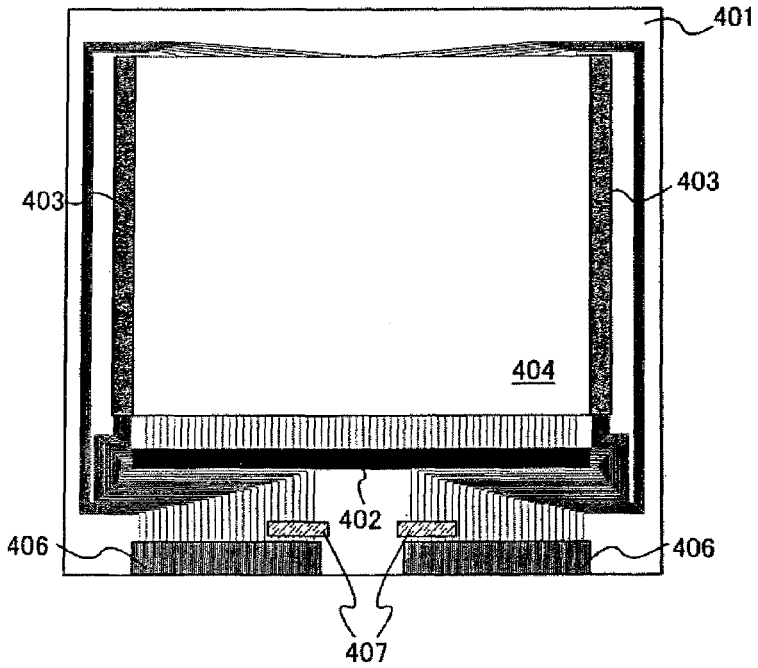
FIG. 12 is a top view of an element substrate of a light emitting device of the invention.

FIG. 12 shows a constitution of a light emitting device of the invention in which a correcting circuit is formed integrally over a substrate the same as that of a pixel portion, a signal line drive circuit and a scanning line drive circuit. A signal line drive circuit 402, a scanning line drive circuit 403, a pixel portion 404, FPC 406 and a correcting circuit 407 are integrally formed over a substrate 401. Further, although in FIG. 12, only an element substrate is shown to make layout of respective circuits clear, actually, a light emitting element is sealed by a cover member to thereby prevent from being exposed to the atmosphere.

Further, although the layout over the substrate is not limited to the example of the drawing, it is preferable to arrange respective blocks to be proximate to each other in consideration of arrangement and wiring length of signal lines.

A video signal is inputted from an outside image source to a video signal correcting circuit inside the correcting circuit 407 via FPC 406. Thereafter, a corrected video signal is inputted to the signal line drive circuit 402.

Meanwhile, a voltage amount outputted from a voltage source is corrected at a voltage correcting circuit inside the correcting circuit. Further, although according to the embodiment, a height of voltage outputted from the voltage source provided to the correcting circuit is corrected by the voltage correcting circuit, the embodiment is not limited to the constitution. It is not necessarily needed to provide the voltage source for controlling the height of the voltage applied to the light emitting element inside the correcting circuit.

According to the example shown in FIG. 12, the correcting circuit 407 is arranged between FPC 406 and signal line drive circuit 402 to thereby facilitate transmission of a control signal.

Next, an explanation will be given with regard to a constitution of the light emitting device of the invention when a correcting circuit separately formed is mounted to a panel by means of a wire bonding method, or COG (Chip On Glass) method.

Figure 13:
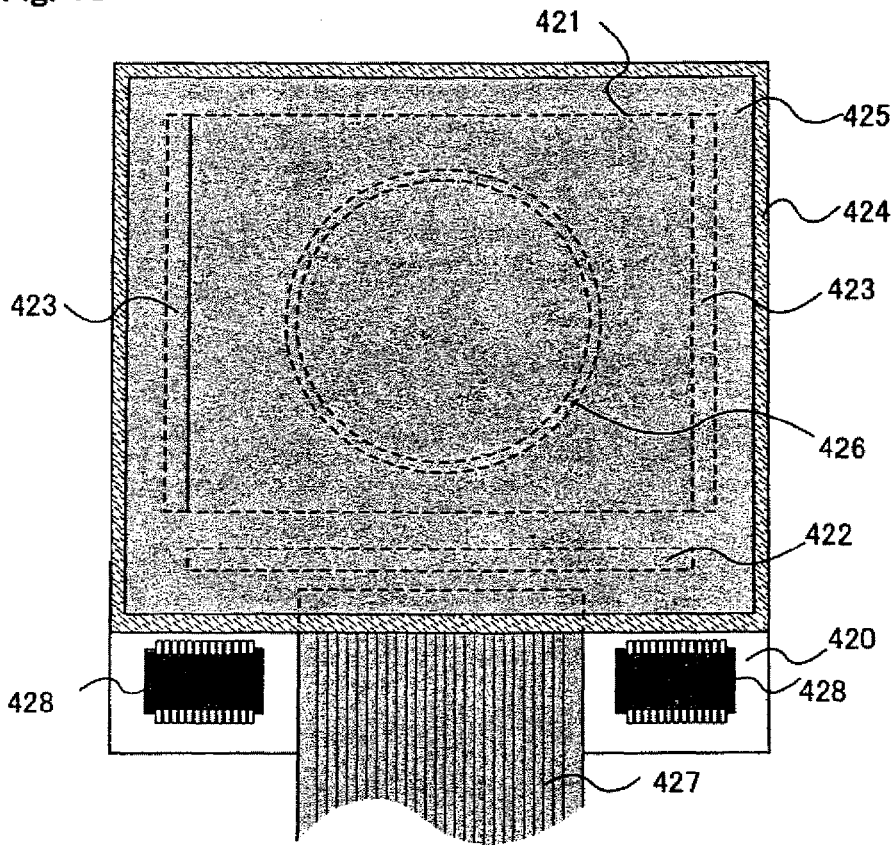
FIG. 13 is a top view of a light emitting device of the invention.

FIG. 13 shows an outlook view of the light emitting device of the embodiment. A seal member 424 is provided to surround a pixel portion 421, a signal line drive circuit 422, and first and second scanning line drive circuits 423 provided over a substrate 420. Further, a cover member 425 is provided over the pixel portion 421, the signal line drive circuit 422 and the first and the second scanning line drive circuits 423. Therefore, the pixel portion 421, the signal line drive circuit 422 and the first and the second scanning line drive circuits 423 are hermetically sealed along with a filler (not illustrated) by the substrate 420, the seal member 424 and the cover member 425.

A recessed portion 426 on a surface of the cover member 425 on the side facing to the substrate 420A is provided and hygroscopic substance or a substance capable of adsorbing oxygen is arranged therein.

A wiring led toward the substrate 420 (lead wiring) is connected to outside circuit or element of the light emitting device via FPC 427 by passing between the seal member 424 and the substrate 420.

The correcting circuit provided to the light emitting device of the invention is formed over a substrate (herein after, referred to as a chip) 428 different from the substrate 420, attached onto the substrate 420 by means of COG (Chip on Glass) method or the like and electrically connected to a power source line and a cathode (not illustrated) formed over the substrate 420.

By attaching the chip 428 formed with the correcting circuit onto the substrate 420 by the wire bonding method, COG method, or the like, the light emitting device can be constituted by one sheet of the substrate, the apparatus per se becomes compact and the mechanical strength is also increased.

Further, it can be carried out to connect the chip to the substrate by using a publicly-known method. Further, a circuit or an element other than the correcting circuit may be attached onto the substrate 420.

The example can be carried out with combined with Example 1 through Example 4.

Example 6

In this example, a constitution of a pixel provided to a light emitting device of the invention will be explained in reference to a circuit diagram shown in FIG. 14.

Figure 14:
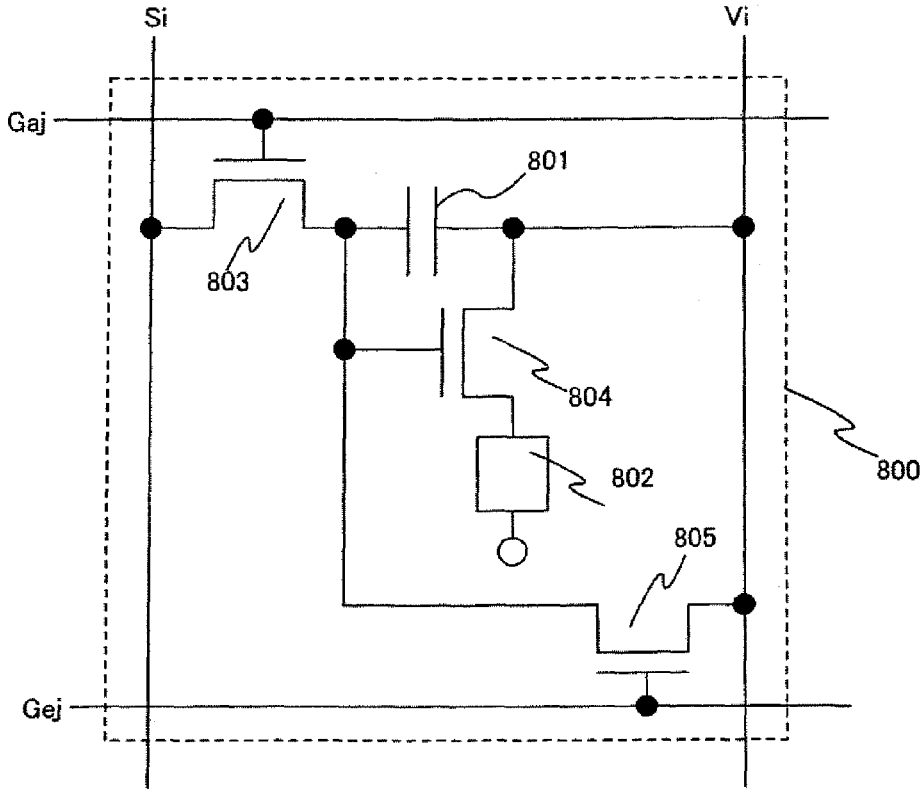
FIG. 14 is a circuit diagram of a pixel of a light emitting device of the invention.

FIG. 14 shows a circuit diagram of a pixel 800 of the example. The pixel 800 includes a signal line Si (one of S1 through Sx), a power source line Vi (one of V1 through Vx) connected to a power source, a first scanning line Gaj (one of Ga1 through Gay) and a second scanning line Gej (one of Ge1 through Gey).

Further, the pixel 800 includes a switching TFT 803, a driving TFT 804, and erasing TFT 805, a storage capacitor 801 and a light emitting element 802. The gate of the switching TFT 803 is connected to the first scanning line Gaj. One of the source and the drain of the switching TFT 803 is connected to the signal line Si and the other thereof is connected to the gate of the driving TFT 804.

The gate of the erasing TFT 805 is connected to the second scanning line Gej. One of the source and the drain of the erasing TFT 805 is connected to the power source line Vi and the other thereof is connected to the gate of the driving TFT 804.

One of two electrodes provided to the storage capacitor 801 is connected to the power source line Vi and the other thereof is connected to the gate of the driving TFT 804. The storage capacitor 801 is provided to hold gate voltage of the driving TFT 804 when the switching TFT 803 is brought into a nonselected state (OFF state). Although the embodiment shows a constitution of providing the storage capacitor 801, the invention is not limited to the constitution and the storage capacitor 801 is not necessarily provided.

One of the source and the drain of the driving TFT 804 is connected to the power source line Vi and the other thereof is connected to a pixel electrode provided to the light emitting element 802.

The light emitting element 802 includes an anode and a cathode and an electroluminescent layer provided between the anode and the cathode. When the anode is connected to the source or the drain of the driving TFT 804, the anode constitutes the pixel electrode and the cathode constitutes a counter electrode. Conversely, when the cathode is connected to the source or the drain of the driving TFT 804, the cathode constitutes the pixel electrode and the anode constitutes the opposed electrode.

Voltage applied to the power source line Vi is corrected by a voltage correcting circuit provided to the correcting circuit. Further, the video signal inputted to the signal line Si is corrected by a video signal correcting circuit provided to the correcting circuit.

Either of n-channel type TFTs and p-channel type TFTs can be used for the switching TFT 803, the driving TFT 804, or the erasing TFT 805. Further, the switching TFT 803, the driving TFT 804, or the erasing TFT 805 may be one other than a single gate structure, a multi gate structure of a double gate structure or a triple gate structure can be applied.

Example 7

In the example, a constitution of a pixel provided to a light emitting device of the invention will be explained in reference to a circuit diagram shown in FIG. 15.

Figure 15:
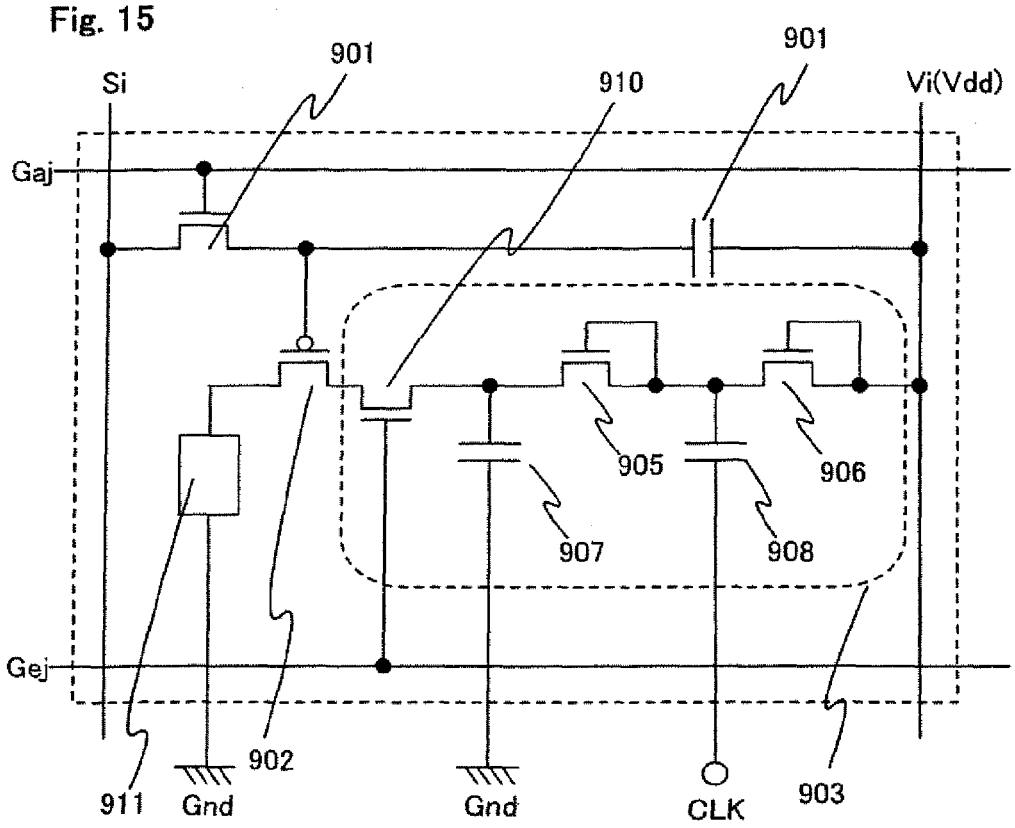
FIG. 15 is a circuit diagram of a pixel of a light emitting device of the invention.

FIG. 15 shows a circuit diagram of a pixel 900 of the example. The pixel 900 includes a signal line Si (one of S1 through Sx), a power source line Vi (one of Vi through Vx) connected to a voltage source, a first scanning line Gaj (one of Gal through Gay) and a second scanning line Gej (one of Gel through Gey).

Further, the pixel 900 includes a switching TFT 901, a driving TFT 902, a charge accumulating portion 903 including TFTs and capacitors, a storage capacitor 904 and a light emitting element 911.

The charge accumulating portion 903 is formed using a booster circuit using TFTs and capacitors and includes three n-channel type TFTs 905, 906, 910 and capacitors for booster circuit 907 and 908 in the example. Further, the booster circuit shown here is only an example and the example is not limited to the booster circuit.

In the example, power source voltage Vdd of the power source supply line Vi is supplied to both of the gate and the drain of the n-channel type TFT 906. Further, Vdd>Gnd. Further, both of the gate and the drain of then channel type TFT 905 are connected to the source of the n-channel type TFT 906. One of two electrodes for capacitor provided to the capacitor 908 is connected to the source of the n-channel type TFT 906 and the other thereof is supplied with a clock signal CLK. Further, one of two electrodes for capacitor provided to the capacitor 907 is connected to the source of the n-channel type TFT 905 and the other thereof is connected to Gnd. When the driving TFT 902 is made ON, voltage of the source of the n-channel type TFT 905 is provided to a pixel electrode of the light emitting element 911 via the n-channel type TFT 910 which is a switching element.

Assume that the clock signal is provided with two values of voltages of Vdd and Gnd. First, when the voltage of the clock signal is Gnd, one of the two electrodes of the capacitor 908 is applied with the voltage Vdd of the power source supply line and other thereof is applied with the voltage Gnd of the clock signal and charge C1 is accumulated.

Meanwhile, one of two electrodes of the capacitor 907 is applied with the voltage Vdd of the power source supply line and other thereof is applied with voltage Gnd of the clock signal and charge C2 is accumulated.

Next, when the voltage of the clock signal is elevated from Gnd to Vdd, a portion of charge of the capacitor 908 is accumulated in the capacitor 907 in accordance with law of conservation of charge. Further, when the driving TFT 902 is made ON by the video signal inputted via the switching TFT, charge accumulated in the capacitor 907 is provided to the light emitting element 911 via the n-channel type TFT 910 which is the switching element. Further, the n-channel type TFT 910 provided in the charge accumulating portion 903 may be connected to control switching between the driving TFT 902 and the light emitting element 911.

In a state in which the electroluminescent layer of the light emitting element is not deteriorated at all, all of charge accumulated in the capacitor 907 is provided to the light emitting element. However, when the light emitting element is deteriorated, since the capacitor 907 is connected in parallel with the light emitting element 911, charge of amount of a threshold of the light emitting element increased by the deterioration is brought into a state of being accumulated and remaining in the capacitor 907.

Further, when the n-channel type TFT 910 is made OFF, and charge is accumulated again to the capacitor 907, charge of the amount of the threshold of the light emitting element increased by the deterioration is added to superpose. Therefore, charge provided from the capacitor 907 to the light emitting element can be maintained constant regardless of the deterioration of the light emitting element.

The example can be carried out with being combined with examples 1 through 6.

Example 8

The light emitting device using the light emitting element is of the self-emission type, and thus exhibits more excellent visibility of the displayed image in a light place as compared to the liquid crystal display device. Furthermore, the light emitting device has a wider viewing angle. Accordingly, the light emitting device can be applied to a display portion in various electronic apparatuses.

Such electronic apparatuses using a light emitting device of the present invention include a video camera, a digital camera, a goggles-type display (head mount display), a navigation system, a sound reproduction device (a car audio equipment and an audio set), a lap-top computer, a game machine, a portable information terminal (a mobile computer, a mobile phone, a portable game machine, an electronic book, or the like), an image reproduction device including a recording medium (more specifically, an device which can reproduce a recording medium such as a digital versatile disc (DVD) and so forth, and includes a display for displaying the reproduced image), or the like. In particular, in the case of the portable information terminal, use of the light emitting device is preferable, since the portable information terminal that is likely to be viewed from a tilted direction is often required to have a wide viewing angle. FIG. 16 respectively shows various specific examples of such electronic apparatuses.

Figure 16A:
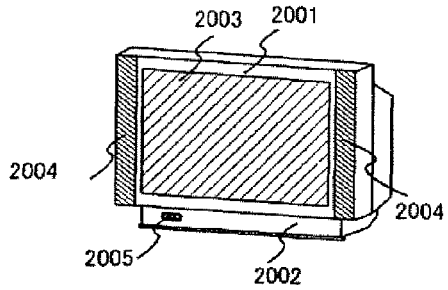
FIGS. 16A to 16H are views of electronic devices using light emitting devices of the invention.

FIG. 16A illustrates a display device which includes a casing 2001, a support table 2002, a display portion 2003, a speaker portion 2004, a video input terminal 2005 or the like. The display device of the present invention is applicable to the display portion 2003. The light emitting device is of the self-emission-type and therefore requires no backlight. Thus, the display portion thereof can have a thickness thinner than that of the liquid crystal display device. The display device is including the entire display device for displaying information, such as a personal computer, a receiver of TV broadcasting and an advertising display.

Figure 16B:
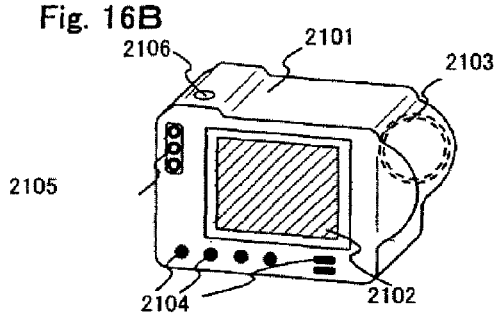

FIG. 16B illustrated a digital still camera which includes a main body 2101, a display portion 2102, an image receiving portion 2103, an operation key 2104, an external connection port 2105, a shutter 2106, or the like. The light emitting device in accordance with the present invention is used as the display portion 2102, thereby the digital still camera of the present invention completing.

Figure 16C:
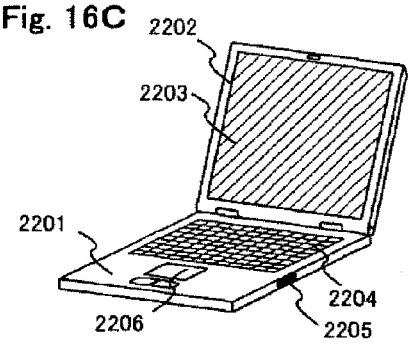

FIG. 16C illustrates a lap-top computer which includes a main body 2201, a casing 2202, a display portion 2203, a keysubstrate 2204, an external connection port 2205, a pointing mouse 2206, or the like. The light emitting device in accordance with the present invention is used as the display portion 2203, thereby the lap-top computer of the present invention completing.

Figure 16D:
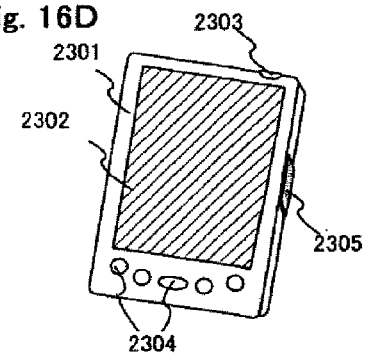

FIG. 16D illustrated a mobile computer which includes a main body 2301, a display portion 2302, a switch 2303, an operation key 2304, an infrared light port 2305, or the like. The light emitting device in accordance with the present invention is used as the display portion 2302, thereby the mobile computer of the present invention completing.

Figure 16E:
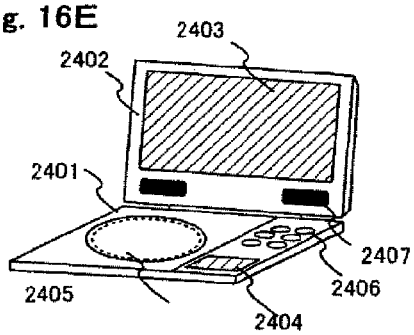

FIG. 16E illustrates a portable image reproduction device including a recording medium (more specifically, a DVD reproduction device), which includes a main body 2401, a casing 2402, a display portion A 2403, another display portion B 2404, a recording medium (DVD or the like) reading portion 2405, an operation key 2406, a speaker portion 2407 or the like. The display portion A 2403 is used mainly for displaying image information, while the display portion B 2404 is used mainly for displaying character information. The image reproduction device including a recording medium further includes a game machine or the like. The light emitting device in accordance with the present invention is used as these display portions A 2403 and B 2404, thereby the image reproduction device of the present invention completing.

Figure 16F:
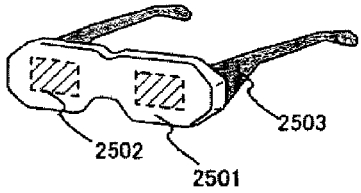

FIG. 16F illustrates a goggle type display (head mounted display) which includes a main body 2501, a display portion 2502, arm portion 2503 or the like. The light emitting device in accordance with the present invention is used as the display portion 2502, thereby the goggle type display of the present invention completing.

Figure 16G:
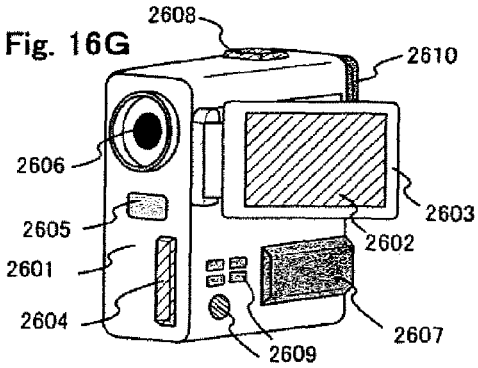

FIG. 16G illustrates a video camera which includes a main body 2601, a display portion 2602, a casing 2603, an external connecting port 2604, a remote control receiving portion 2605, an image receiving portion 2606, a battery 2607, a sound input portion 2608, an operation key 2609, an eyepiece portion 2610, or the like. The light emitting device in accordance with the present invention is used as the display portion 2602, thereby the video camera of the present invention completing.

Figure 16H:
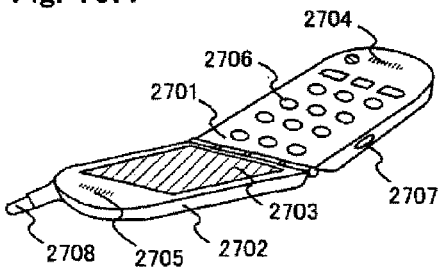
Figure 17A:
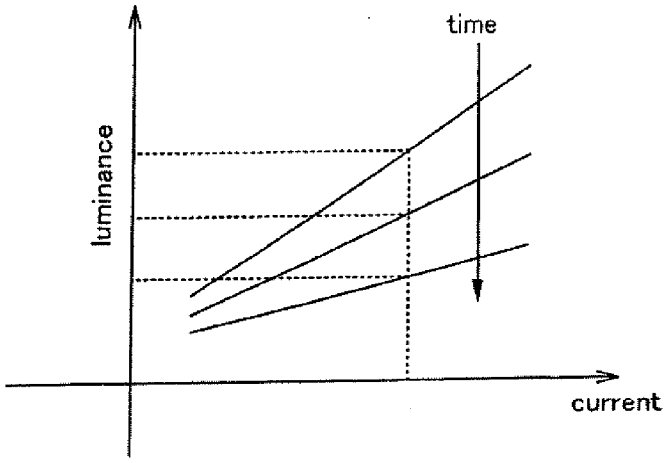
Fig. 17A PRIOR ART
FIGS. 17A, 17B and 17C are diagrams showing a change in luminance of light emitting device by deterioration.
Figure 17B:
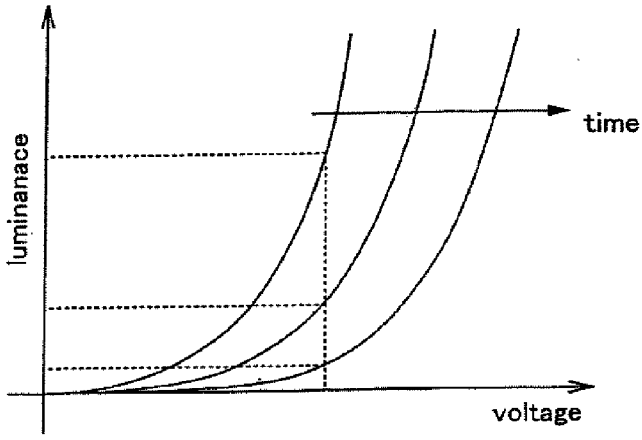
Fig. 17B PRIOR ART
Figure 17C:
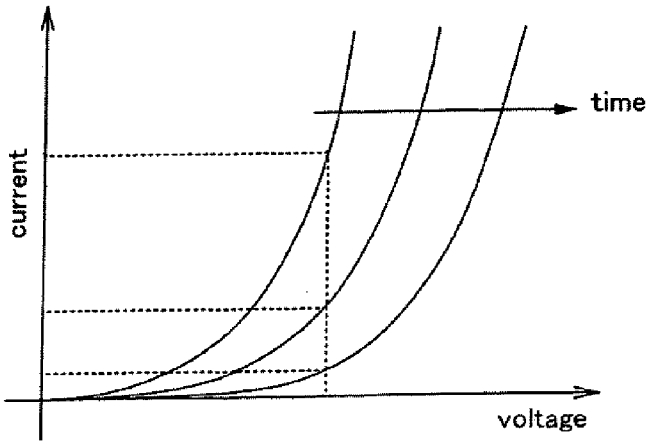
Fig. 17C PRIOR ART
Figure 18:
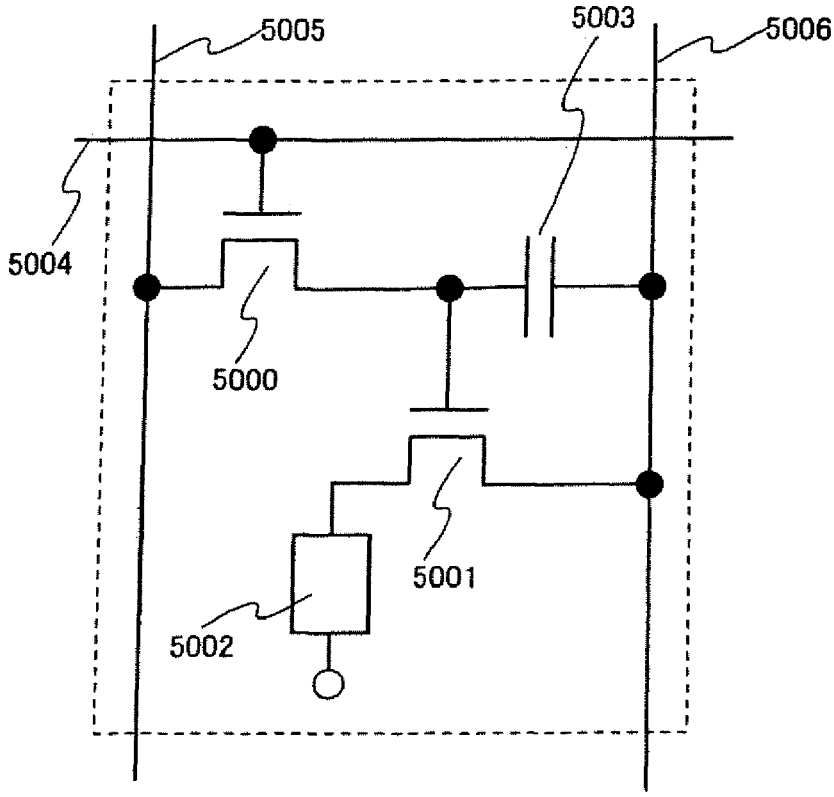
Fig. 18 PRIOR ART
FIG. 18 is a circuit diagram of a pixel of general light emitting device.

FIG. 16H illustrates a mobile phone which includes a main body 2701, a casing 2702, a display portion 2703, a sound input portion 2704, a sound output portion 2705, an operation key 2706, an external connecting port 2707, an antenna 2708, or the like. Note that the display portion 2703 can reduce power consumption of the mobile telephone by displaying white-colored characters on a black-colored background. The light emitting device in accordance with the present invention is used as the display portion 2703, thereby the mobile phone of the present invention completing.

When the brighter luminance of light emitted from an electric field emission material becomes available in the future, the light emitting device in accordance with the present invention will be applicable to a front-type or rear-type projector in which light including output image information is enlarged by means of lenses or the like to be projected.

The aforementioned electronic apparatuses are more likely to be used for display information distributed through a telecommunication path such as Internet, a CATV (cable television system), and in particular likely to display moving picture information. The light emitting device is suitable for displaying moving pictures since the electric field emission material can exhibit high response speed.

A portion of the light emitting device that is emitting light consumes power, so it is desirable to display information in such a manner that the light emitting portion therein becomes as small as possible. Accordingly, when the light emitting device is applied to a display portion which mainly displays character information, e.g., a display portion of a portable information terminal, and more particular, a portable telephone or a sound reproduction device, it is desirable to drive the light emitting device so that the character information is formed by a light emitting portion while a non-emission portion corresponds to the background.

As set forth over, the present invention can be applied variously to a wide range of electronic apparatuses in all fields. The electronic apparatuses in this example can be obtained by utilizing a light emitting device having the structure in which the structures in Example 1 through 7 are freely combined.

The invention can provide a light emitting device capable of restraining nonuniformity of luminance by a deterioration of an electroluminescent layer and a dispersion in TFT characteristics among pixels and capable of restraining a reduction in luminance of a total of a screen.

What is claimed is:

1. A manufacturing method of a light emitting device comprising a display panel comprising a pixel comprising a light emitting element and a transistor, the method comprising:

obtaining a first data by measuring a current amount of the transistor with a current measuring circuit;

storing a second data for correcting a video signal input to the pixel into a memory circuit, wherein the second data is based on at least the first data; and separating the current measuring circuit from the light emitting device.

2. The manufacturing method according to claim 1, wherein the memory circuit is a nonvolatile memory.

3. The manufacturing method according to claim 1, wherein the transistor is a thin film transistor.

4. The manufacturing method according to claim 1, further comprising a step of storing the first data to a volatile memory.

5. The manufacturing method according to claim 1, wherein the video signal is corrected in a digital data processing.

6. A manufacturing method of a light emitting device comprising a display panel comprising a pixel comprising a light emitting element and a transistor, the method comprising:

obtaining a first data by measuring a current amount of the transistor with a current measuring circuit;

storing a second data for correcting a video signal input to the pixel into a memory circuit, wherein the second data is based on at least the first data;

coupling the memory circuit to the display panel after storing the second data; and separating the current measuring circuit from the light emitting device.

7. The manufacturing method according to claim 6, wherein the memory circuit is a nonvolatile memory.

8. The manufacturing method according to claim 6, wherein the transistor is a thin film transistor.

9. The manufacturing method according to claim 6, further comprising a step of storing the first data to a volatile memory.

10. The manufacturing method according to claim 6, wherein the video signal is corrected in a digital data processing.

11. A manufacturing method of a light emitting device comprising a display panel comprising a pixel comprising a light emitting element and a transistor, the method comprising:

obtaining a first data by measuring a current amount of the transistor with a current measuring circuit;

coupling a memory circuit to the display panel;

storing a second data for correcting a video signal input to the pixel into a memory circuit after coupling the memory circuit to the display panel, wherein the second data is based on at least the first data; and separating the current measuring circuit from the light emitting device.

12. The manufacturing method according to claim 11, wherein the memory circuit is a nonvolatile memory.

13. The manufacturing method according to claim 11, wherein the transistor is a thin film transistor.

14. The manufacturing method according to claim 11, further comprising a step of storing the first data to a volatile memory.

15. The manufacturing method according to claim 11, wherein the video signal is corrected in a digital data processing.

16. A manufacturing method of a light emitting device comprising a display panel comprising a pixel comprising a light emitting element and a transistor, the method comprising:

supplying a first video signal to the pixel;

obtaining a first data by measuring a current amount of the transistor with a current measuring circuit after inputting the first video signal to the pixel;

storing a second data for correcting a second video signal input to the pixel into a memory circuit, wherein the second data is based on at least the first data; and separating the current measuring circuit from the light emitting device.

17. The manufacturing method according to claim 16, wherein the memory circuit is a nonvolatile memory.

18. The manufacturing method according to claim 16, wherein the transistor is a thin film transistor.

19. The manufacturing method according to claim 16, further comprising a step of storing the first data to a volatile memory.

20. The manufacturing method according to claim 16, wherein the second video signal is corrected in a digital data processing.

* * * * *

UNITED STATES PATENT AND TRADEMARK OFFICE

CERTIFICATE OF CORRECTION

PATENT NO. : 7,863,824 B2
APPLICATION NO. : 12/272825
DATED : January 4, 2011
INVENTOR(S) : Shunpei Yamazaki et al.

It is certified that error appears in the above-identified patent and that said Letters Patent is hereby corrected as shown below:

column 1, line 8, “herein after” should read “hereinafter”

column 1, line 33, “herein after” should read “hereinafter”

column 1, line 56, “there between” should read “therebetween”

column 1, line 64, “there between” should read “therebetween”

column 13, line 54, “5,” should be omitted.

column 14, line 28, “circuits” should read “circuit,”

column 14, line 32, “Further;” should read “Further,”

column 14, line 33, “herein after” should read “hereinafter”

column 18, line 24, “where as” should read “whereas”

column 18, line 56, “000000” should read “ “000000” ”

column 21, line 54, “herein after” should read “hereinafter”

column 23, line 8, “(one of Vi through Vx)” should read “(one of V1 through Vx)”

column 23, line 10 “Gal through Gay)” should read “Ga1 through Gay)”

column 23, line 10 “(one of Gel” should read “(one of Ge1”

column 23, line 26, “then channel” should read “the n-channel”

Signed and Sealed this
Fifth Day of July, 2011

David J. Kappos

David J. Kappos
*Director of the United States Patent and Trademark Office*